US008851288B2

(12) United States Patent
Yamauchi

(10) Patent No.: US 8,851,288 B2
(45) Date of Patent: Oct. 7, 2014

(54) COLLAPSIBLE CONTAINER

(75) Inventor: Hisatoshi Yamauchi, Mizuho (JP)

(73) Assignee: Sanko Co., Ltd., Mizuho (JP)

( * ) Notice: Subject to any disclaimer, the term of this patent is extended or adjusted under 35 U.S.C. 154(b) by 915 days.

(21) Appl. No.: 12/289,241

(22) Filed: Oct. 23, 2008

(65) Prior Publication Data

US 2009/0134176 A1 May 28, 2009

(30) Foreign Application Priority Data

Nov. 28, 2007 (JP) ..... 2007-306912

(51) Int. Cl.
*B65D 6/18* (2006.01)

(52) U.S. Cl.
USPC ..... 206/506; 220/6; 220/7

(58) Field of Classification Search
CPC ... B65D 11/18; B65D 11/1806; B65D 11/184
USPC ..... 206/506; 220/4.28, 6, 666, 7
See application file for complete search history.

(56) References Cited

U.S. PATENT DOCUMENTS

| | | | | |
|---|---|---|---|---|
| 2,765,099 | A * | 10/1956 | Lively | 206/506 |
| 4,905,833 | A * | 3/1990 | Kreeger et al. | 206/506 |
| 6,286,701 | B1 * | 9/2001 | Umiker | 220/6 |
| 6,616,003 | B1 * | 9/2003 | Polenta | 220/7 |
| 6,820,761 | B1 * | 11/2004 | Mouri et al. | 220/6 |
| 7,195,127 | B2 * | 3/2007 | Hsu et al. | 220/6 |
| 7,740,146 | B2 * | 6/2010 | Cavalcante et al. | 220/6 |
| 7,886,926 | B2 * | 2/2011 | Orgeldinger | 220/4.03 |
| 2007/0095692 | A1 * | 5/2007 | Apps | 206/386 |
| 2007/0095842 | A1 * | 5/2007 | Apps | 220/600 |
| 2007/0125779 | A1 * | 6/2007 | Cope | 220/6 |
| 2007/0194023 | A1 * | 8/2007 | Apps et al. | 220/6 |
| 2008/0116201 | A1 * | 5/2008 | Baltz | 220/4.28 |
| 2008/0169285 | A1 * | 7/2008 | Marazita et al. | 220/7 |
| 2009/0134176 | A1 * | 5/2009 | Yamauchi | 220/666 |

FOREIGN PATENT DOCUMENTS

| | | |
|---|---|---|
| JP | A-2002-2696 | 1/2002 |
| JP | A-2003-11975 | 1/2003 |
| JP | A-2003-205938 | 7/2003 |
| JP | A-2003-335331 | 11/2003 |

* cited by examiner

*Primary Examiner* — Stephen Castellano
(74) *Attorney, Agent, or Firm* — Oliff PLC

(57) ABSTRACT

A collapsible container which includes a rectangular bottom wall and sidewalls pivotally joined to respective outer edges of the bottom wall and is changeable between an assembled state in which the sidewalls are raised from the bottom wall and a folded state in which the sidewalls are folded to be superimposed on the bottom wall comprises a pair of band plate members extending along upper edges of a pair of first sidewalls opposed to each other and a band plate hinge mechanism joining the band plate members near to top surfaces of the first sidewalls so that the band plate members are pivotable between a horizontal posture of protruding from the first sidewalls horizontally inward and a rising posture of rising from the first sidewalls vertically upward. The band plate hinge mechanism is capable of positioning the band plate members in the horizontal posture. The band plate members assuming the horizontal posture are arranged as displaced lower relative to the top surfaces of the first sidewalls.

8 Claims, 21 Drawing Sheets

COLLAPSIBLE CONTAINER

BACKGROUND OF THE INVENTION

1. Field of the Invention

The present invention relates to a collapsible container which includes a rectangular bottom wall and sidewalls pivotally joined to respective outer edges of the bottom wall and is changeable between an assembled state in which the sidewalls are raised from the bottom wall and a folded state in which the sidewalls are folded to be superimposed on the bottom wall.

2. Description of the Related Art

Sidewalls are individually formed in a collapsible container of the above-described type. Accordingly, the sidewalls are easier to bend as compared with noncollapsible containers comprising integrally formed sidewalls. When two or more collapsible containers are stuck onto another, one collapsible container falls into the other or another collapsible container, since a top opening of the collapsible container is spread. In particular, when a smaller container having the same length or width as the collapsible container is placed on the collapsible container, the smaller container often falls into the collapsible container.

In view of the above-described problem, one conventional collapsible container has projections formed on upper surfaces of sidewalls, and recesses are formed in the underside of the other or another container to be put onto the container with the projections. The projections and recesses are brought into a concavoconvex engagement so that the top opening of the collapsible container is prevented from spreading. See JP-A-2002-2696, for example.

In the above-described collapsible container, however, bringing the containers into a concavoconvex engagement is troublesome when the other or another container is put onto the collapsible container. Furthermore, recent collapsible containers tend to have sidewalls with reduced thicknesses in order to reduce the height of the sidewalls in a folded state. As a result, the upper container falls into the lower container during the piling work if displaced slightly by a thickness of the sidewall.

SUMMARY OF THE INVENTION

The present invention was made in view of the foregoing circumstances, and therefore, an object of the present invention is to provide a collapsible container which can be easily piled up and reliably prevented from falling into a lower collapsible container.

A collapsible container in accordance with a first preferred form of the present invention includes a rectangular bottom wall and sidewalls pivotally joined to respective outer edges of the bottom wall and is changeable between an assembled state in which the sidewalls are raised from the bottom wall to be joined with one another and a folded state in which the sidewalls are folded on the bottom wall. The collapsible container takes a form of a rectangular parallelepiped with a top opening in the assembled state. The collapsible container can be piled upon another as prevented from lateral slip by fitting a protrusion formed on an underside of the another container with an inside of the top opening. The collapsible container comprises a pair of band plate members extending along upper edges of a pair of first sidewalls opposed to each other at either of length or breadth of the bottom wall, and a band plate hinge mechanism joining the band plate members near to top surfaces of the first sidewalls so that the band plate members are pivotable between a horizontal posture of protruding from the first sidewalls horizontally inward and a rising state of rising from the first sidewalls vertically upward. The band plate hinge mechanism is capable of positioning the band plate members in the horizontal posture. The band plate members assuming the horizontal posture are arranged as displaced lower relative to the top surfaces of the first sidewalls.

When a collapsible container is to be assembled and another collapsible container is to be placed on the collapsible container, the band plate members are horizontalized so as to protrude inside from the upper ends of the first sidewalls. As a result, even when the another container is put on the collapsible container as being displaced slightly from a normal position, the another container is supported by the band plate members from below, thereby being prevented from falling into the collapsible container. Furthermore, the another container can be slid on the band plate members to be moved to the normal superimposed position. More specifically, after having been positioned on the collapsible container so as to assume a rough position, a fine adjustment is carried out so that the another container is moved to the normal superimposed position. Consequently, the stacking work can be rendered easier as compared with the conventional collapsible containers. Furthermore, the another container can be prevented from falling into the collapsible container even when the first sidewalls are spread outward to some extent. To fold the collapsible container, the band plate members are caused to rise from the first sidewalls vertically into the rising state and then, the sidewalls are folded onto the bottom wall.

In a second preferred form, the band plate hinge mechanism joins the band plate members to the first sidewalls at a plurality of positions dispersed over the entire upper edges of the first sidewalls. Therefore, the band plate members in the horizontal state serve as ribs reinforcing the sidewalls in the entire lengthwise direction. Consequently, the first sidewalls can be prevented from being bent inward or outward and accordingly, the shape of the top opening of the collapsible container can be rendered more stable.

In a third preferred form, the band plate hinge mechanism includes a plurality of hinge legs protruding sideways from a side directed widthwise with respect to the band plate members, a pair of hinge shafts protruding from both sides of a distal end of each hinge leg, the sides being directed lengthwise with respect to the band plate members, a plurality of leg receiving recesses which are formed in the upper ends of the first sidewalls, the recesses being open to top faces and inner faces of the first sidewalls and receiving the hinge legs together with the hinge shafts respectively, hinge bearing entrances which are formed by widening lower ends of the inner face openings of the leg receiving recesses, the openings open to the inner faces of the first sidewalls so that the lower ends correspond to the hinge shafts respectively, the hinge bearing entrances allowing the hinge shafts to be received in the leg receiving recesses from the inner face side of the first sidewalls, and shaft positioning portions formed in the leg receiving recesses by upwardly widening inner portions of the hinge bearing entrances, wherein the hinge legs are received in the leg receiving recesses together with the hinge shafts with the band plate members assuming the rising posture, and when the band plate members are caused to assume the horizontal posture, the hinge legs and bottom faces of the leg receiving recesses are abutted against each other, so that the hinge shafts are moved upward to be received by the shaft positioning portions, whereby the hinge legs are positioned in three of directions orthogonal to the hinge shafts except for a downward direction.

In the above-described collapsible container, the hinge legs are received in the leg receiving recesses provided in the first sidewalls while the band plate members are caused to rise, so that the band plate members can be joined pivotally to the first sidewalls. When the band plate members are caused to assume a horizontal posture, the hinge legs and bottom faces of the leg receiving recesses are abutted against each other such that the hinge shafts are moved upward to be received by the shaft positioning portions, whereby the hinge legs are positioned in three of directions orthogonal to the hinge shafts except for a downward direction. The downward movement of the hinge legs is limited by the self-weight of the band plate members assuming the horizontal posture. As a result, the horizontal band plate members and the first sidewalls are united with each other, whereupon the band plate members can serve as ribs which reinforce the first sidewalls.

In a fourth preferred form, the collapsible container further comprises rising engagement portions which are formed on the band plate members and the sidewalls so as to engage with each other with the band plate members assuming a rising posture, thereafter holding the band plate members in the rising posture.

In the above-described construction, the band plate members can be held in the rising posture by the rising engagement portions formed on the band plate members and the sidewalls. Consequently, luggage can easily be taken in and out of the collapsible container.

In a fifth preferred form, each band plate member has both lengthwise end faces formed with a pair of horizontal-posture support protrusions located at ends of a side distant from a center of pivoting. A pair of second sidewalls which are sidewalls other than the first sidewalls have upper edges formed with horizontal-posture retaining recesses which receive the horizontal-posture support protrusions and then support the protrusions from below when the band plate members assume the horizontal posture.

In the above-described construction, the horizontal-posture support protrusions are received in the horizontal-posture retaining recesses formed in the upper ends of the second sidewalls and then supported from below when the band plate members assume the horizontal posture of protruding inward from the upper ends of the first sidewalls. Consequently, the band plate members can be prevented from being deformed due to load of the another container.

BRIEF DESCRIPTION OF THE DRAWINGS

Other objects, features and advantages of the present invention will become clear upon reviewing the following description of the preferred embodiments, in which.

DETAILED DESCRIPTION OF THE INVENTION

Figure 1:
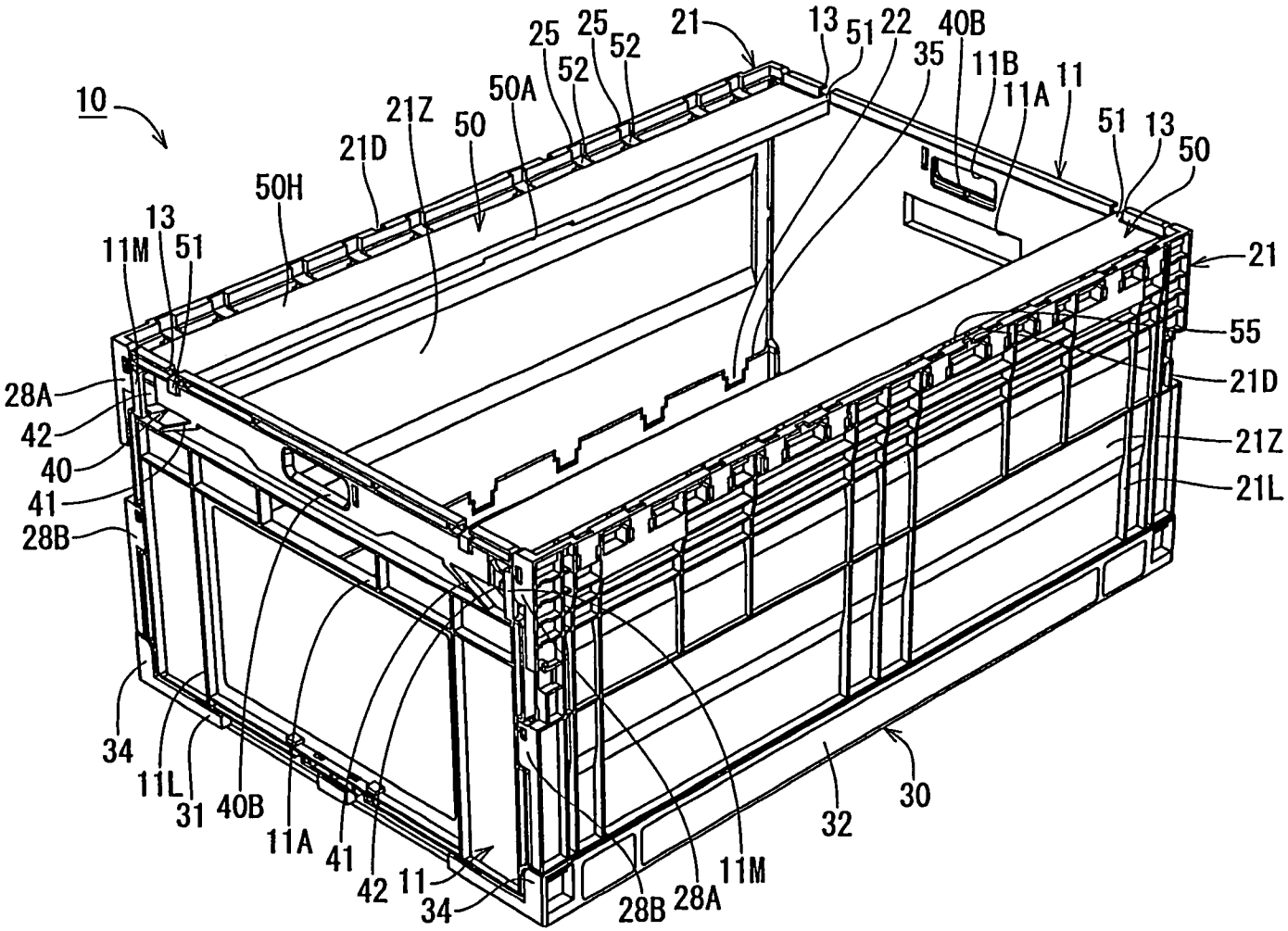
FIG. 1 is a perspective view of a collapsible container in accordance with a first embodiment of the present invention.

An embodiment of the present invention will be described with reference to FIGS. 1 to 15. Referring to FIG. 1, a collapsible container 10 of the embodiment is shown. The collapsible container 10 is rectangular when viewed two-dimensionally and has a rectangular parallelepiped structure having a top opening. The collapsible container 10 includes a bottom wall 30, a pair of short-side sidewalls 11 pivotally joined to a pair of shorter side outer edges of the bottom wall 30 respectively, and a pair of long-side sidewalls 21 pivotally joined to a pair of longer side outer edges of the bottom wall 30 respectively. The long-side sidewalls 21 and the short-side sidewalls 11 correspond to first and second sidewalls of the present invention respectively. Each short-side sidewall 11 has an upper end to which a locking member 40 is mounted. Each long-side sidewall 21 has an upper end to which a band plate member 50 in accordance with the present invention is mounted. The collapsible container 10 is changeable between an assembled state (see FIG. 1) in which the short-side and long-side sidewalls 11 and 21 are raised from the bottom wall 30 and joined to one another and a folded state (see FIG. 12) in which the short-side sidewalls 11 are folded onto the bottom wall 30 so as to lay one upon the other and then one of the long-side sidewalls 21 is folded onto the short-side sidewalls 11, as shown in FIG. 11, and the other long-side sidewall 21 is folded onto the folded long-side sidewall 21.

The bottom wall 30 includes a pair of shorter side outer edges and a pair of longer side outer edges as shown in FIG. 1. A pair of short-side bottom protrusions 31 protrude upward from the shorter side outer edges respectively. A pair of long-side bottom protrusions 32 protrude upward from the long-side outer edges respectively. Each short-side bottom protrusion 31 has both ends provided with respective corner support walls 34 both having the same height as the long-side bottom protrusions 32. Each whole short-side bottom protrusion 31 except the corner support wall 34 is lower than each long-side bottom protrusion 32.

Figure 5:
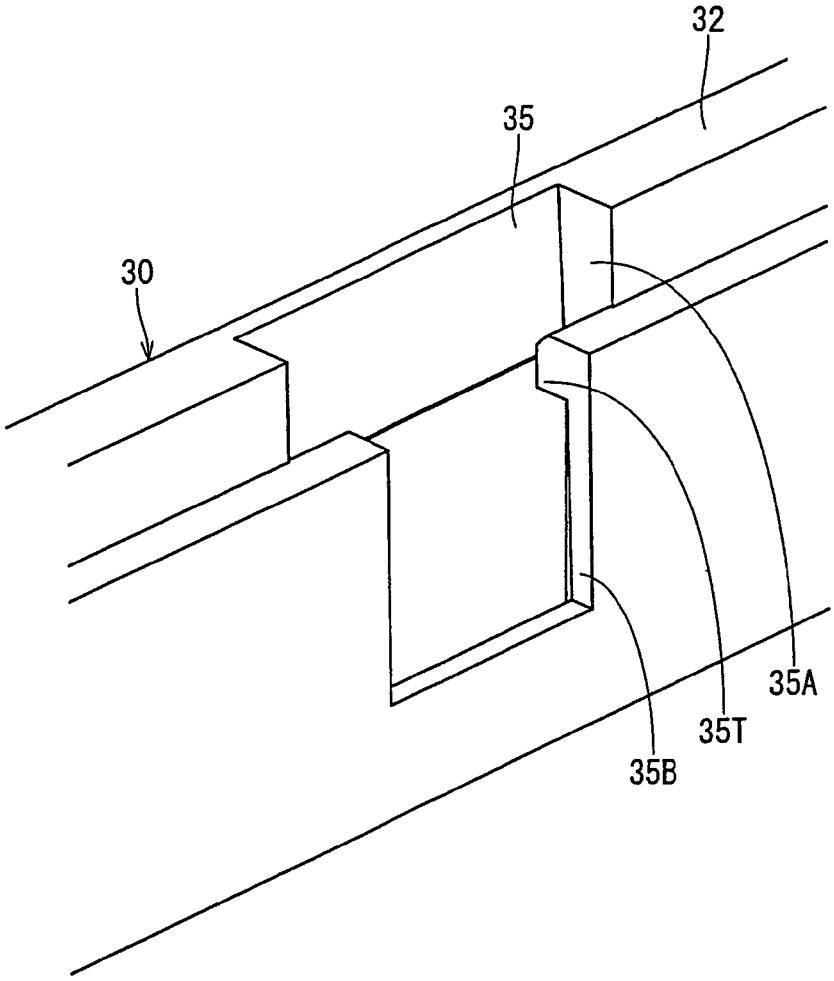
FIG. 5 is a perspective view of an arm receiving portion.
Figure 12:
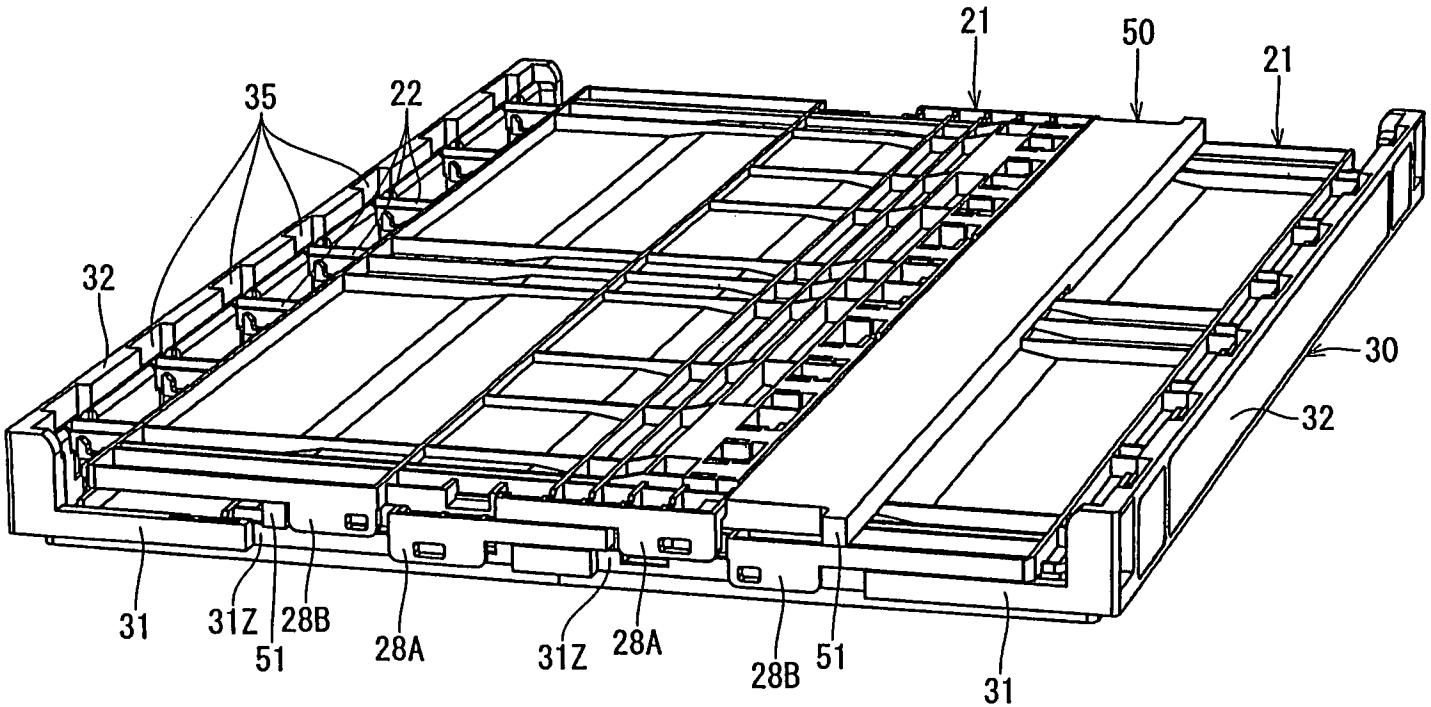
FIG. 12 is a perspective view of the collapsible container in a folded state.

Each long-side bottom protrusion 32 has a plurality of arm receiving portions 35 formed lengthwise at predetermined intervals as shown in FIG. 12. FIG. 5 is an enlarged view of the arm receiving portions 35. As shown, each arm receiving portion 35 is open to the top and an inner face of each long-side bottom protrusion 32. Each arm receiving portion 35 has a top opening 35A and an inner opening 35B. The top opening 35A and an upper end of the inner opening 35B are wider than a lower end of the inner opening 35B. An inner face of each arm receiving portion 35 has two retaining protrusions 35T formed on opposed sides of the inner opening 35B. A plurality of arm receiving portions which are similar to those of each long-side bottom protrusion 32 are also formed in each short-side bottom protrusion 31 although not shown.

Figure 13:
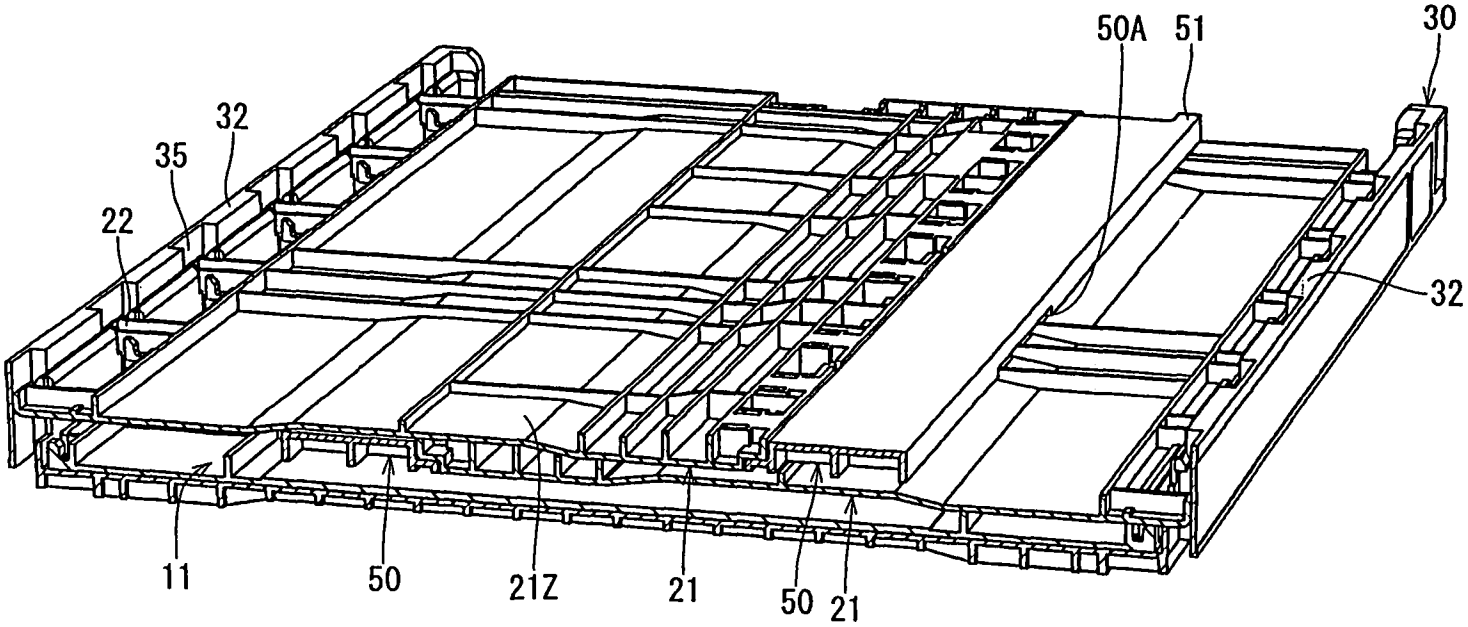
FIG. 13 is a partially broken perspective view of the collapsible container in the folded state.

Each long-side sidewall 21 comprises a horizontally long flat plate and a lattice-shaped outer rib 21L protruding from an outer surface of the flat plate as shown in FIG. 1. The horizontally long flat plate has a heightwise middle portion which expands slightly outward over an entire lateral dimension, thereby forming a sidewall expanding portion 21Z. The lattice-shaped outer rib 21L includes an upper portion having a larger amount of expansion than the long-side sidewall 21. When one of the long-side sidewalls 21 is folded onto the other long-side sidewall 21, the portion with the larger expansion of the outer rib 21L on the lower long-side sidewall 21 is adapted to be received in the sidewall expanding portion 21Z of the upper long-side sidewall 21, as shown in FIG. 13.

Figure 3:
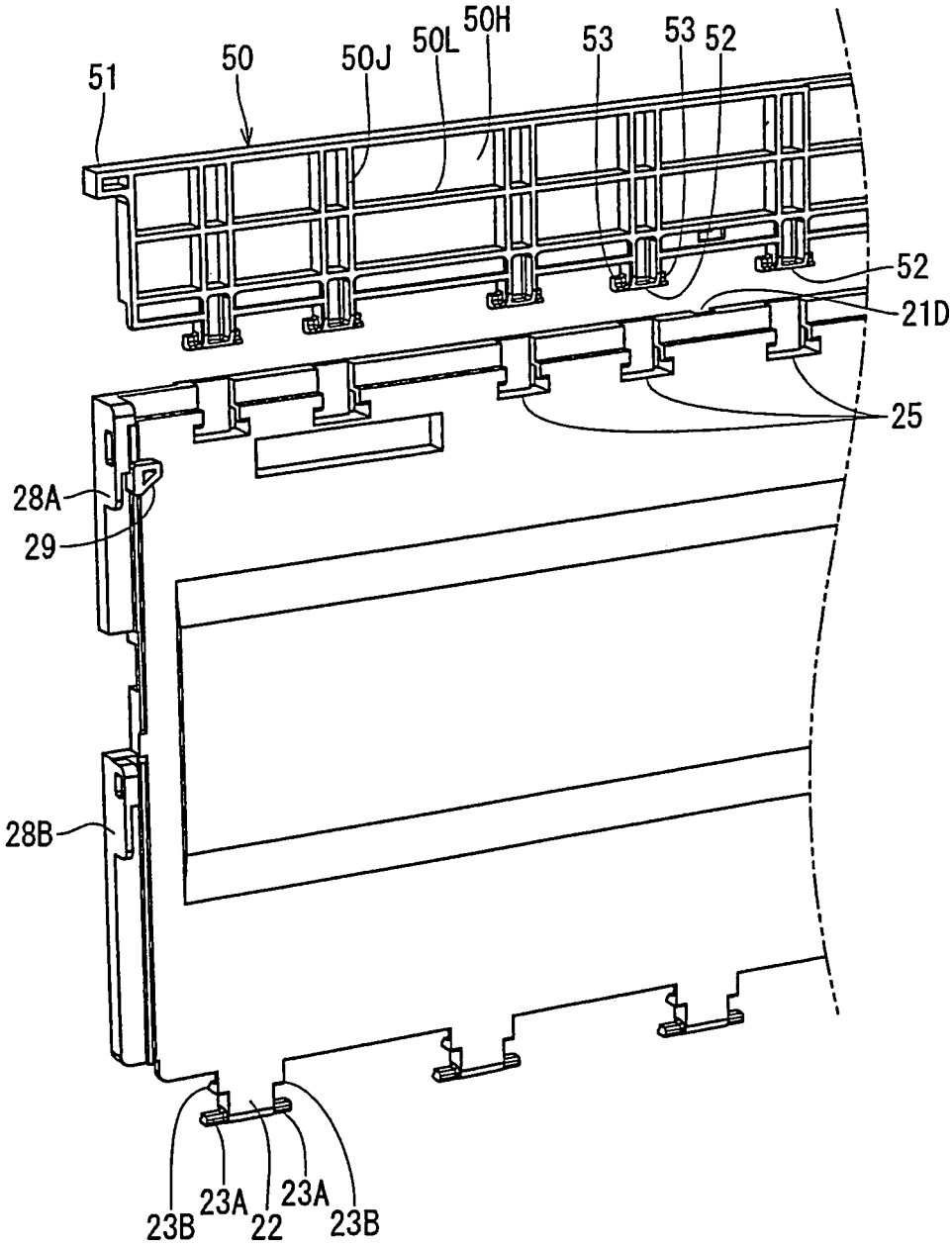
FIG. 3 is a perspective view of long-side sidewalls and band plate members as viewed from the inside of the collapsible container.

Each long-side sidewall 21 has a plurality of hinge legs 22 which are formed so as to correspond to the arm receiving portions 35 respectively as shown in FIG. 12. The hinge legs 22 hang from the lower end of each long-side sidewall 21 as shown in FIG. 3. Furthermore, a pair of hinge shafts 23A protrude from both sides of a lower end of each hinge leg 22 in the lateral direction of each long-side sidewall 21. A pair of proximal end protrusions 23B further protrude from both sides of a proximal end of each hinge leg 22 laterally with respect to each long-side sidewall 21. The proximal end protrusions 23B are continuous to and coplanar with an inner surface of each long-side sidewall 21, whereupon the proximal end can be regarded as wider than the distal end when the hinge leg 22 is viewed from the inside of the long-side sidewall 21.

Each hinge leg 22 including the hinge shafts 23A is received by the arm receiving portion of the bottom wall 30 from the top opening 35A side. The hinge shafts 23A are locked by the retaining protrusions 35T to be prevented from falling off. Each long-side sidewall 21 is caused to pivot about the hinge shafts 23A relative to the bottom wall 30, whereby each long-side sidewall 21 is switchable between a rising state (the state as shown in FIG. 1) and a horizontal state (the state as shown in FIG. 12). Furthermore, when each long-side sidewall is caused to rise, the proximal end protrusions 23B close the top opening 35A of the arm receiving portion 35, and the underside of each long-side sidewall 21 abuts against an upper surface of the long-side bottom protrusion 32.

Each side edge of each long-side sidewall 21 has two connecting protrusions 28A and 28B formed on the upper end and a vertically middle portion thereof respectively as shown in FIG. 11. The connecting protrusions 28A, 28B protrude from the long-side sidewall 21 toward the short-side sidewall 11 side. Each long-side sidewall 21 has two connecting projections 29 which are formed on an inner upper end thereof so as to face inner surfaces of the respective connecting protrusions 28A as shown in FIG. 3.

Each short-side sidewall 11 has a pair of outer ribs 11L formed on an outer surface of the rectangular flat plate so as to protrude as shown in FIG. 1. Each short-side sidewall 11 also has a plurality of hinge legs (not shown) which are formed on a lower end thereof, similar to each long-side sidewall 21. The hinge legs of each short-side sidewall 11 are received by respective arm receiving portions (not shown) formed in a short-side bottom protrusion 31 of the bottom wall 30 so that each short-side sidewall 11 is pivotally connected to the bottom wall 30. When the collapsible container 10 is in the assembled state, the outer surface of each short-side sidewall 11 abuts against the connecting protrusions 28A, 28B of each long-side sidewall 21 such that each short-side sidewall 11 can be prevented from falling outward.

As shown in FIG. 1, a hand hole 11A is formed in a lateral middle portion and near the upper end of each short-side sidewall 11. A locking member 40 for connecting the short-side and long-side sidewalls 11 and 21 together is mounted on the upper end of the outer surface of each short-side sidewall 11 so as to be located between the paired outer ribs 11L which extend parallel laterally. The locking member 40 is formed into a plate shape and extends over an entire lateral dimension of each short-side sidewall 11. The locking member 40 has both ends formed with respective locking pieces 42 which are located so as to be displaced downward relative to an upper face of the entire locking member 40. Bridging walls 11M (see FIG. 10) bridges the aforesaid paired outer ribs 11L so as to cover the locking pieces 42 from the outer surface side. Each locking piece 42 projects sidewise further than the upper end side of each short-side sidewall 11 although the structure is not shown.

The locking member 40 has an underside from which a pair of flexible arms 41 extend obliquely downward into folding-fan shapes. The flexible arms 41 have respective lower ends which abut against the outer ribs 11L at a location lower than the locking member 40, whereby the locking member 40 is upwardly biased by the spring force of the flexible arms 41. While the flexible arms 41 are located at the upper end within a movable range, the locking pieces 42 are held between the connecting protrusions 28A (see FIG. 3) and the connecting projections 29 (see FIG. 3) so that each short-side sidewall 11 can be prevented from falling inside. In order that each short-side sidewall 11 may be caused to fall inside, the locking member 40 is moved downward against the spring force of the flexible arms 41. For this purpose, the locking member 40 has a lengthwise central operation hole 40B extending therethrough. Furthermore, each short-side sidewall 11 has an auxiliary operation hole 11B (see FIG. 1) which extends therethrough so as to correspond to the operation hole 40B. A lower edge of the operation hole 40B is normally displaced upward from a lower edge of the auxiliary operation hole 11B. The locking member 40 is moved downward up to a position where the lower edge of the operation hole 40B corresponds with the lower edge of the auxiliary operation hole 11B, whereupon the connecting projections 29 are disengaged from the locking pieces 42. As a result, the short-side sidewall 11 can be caused to fall inside.

Figure 2:
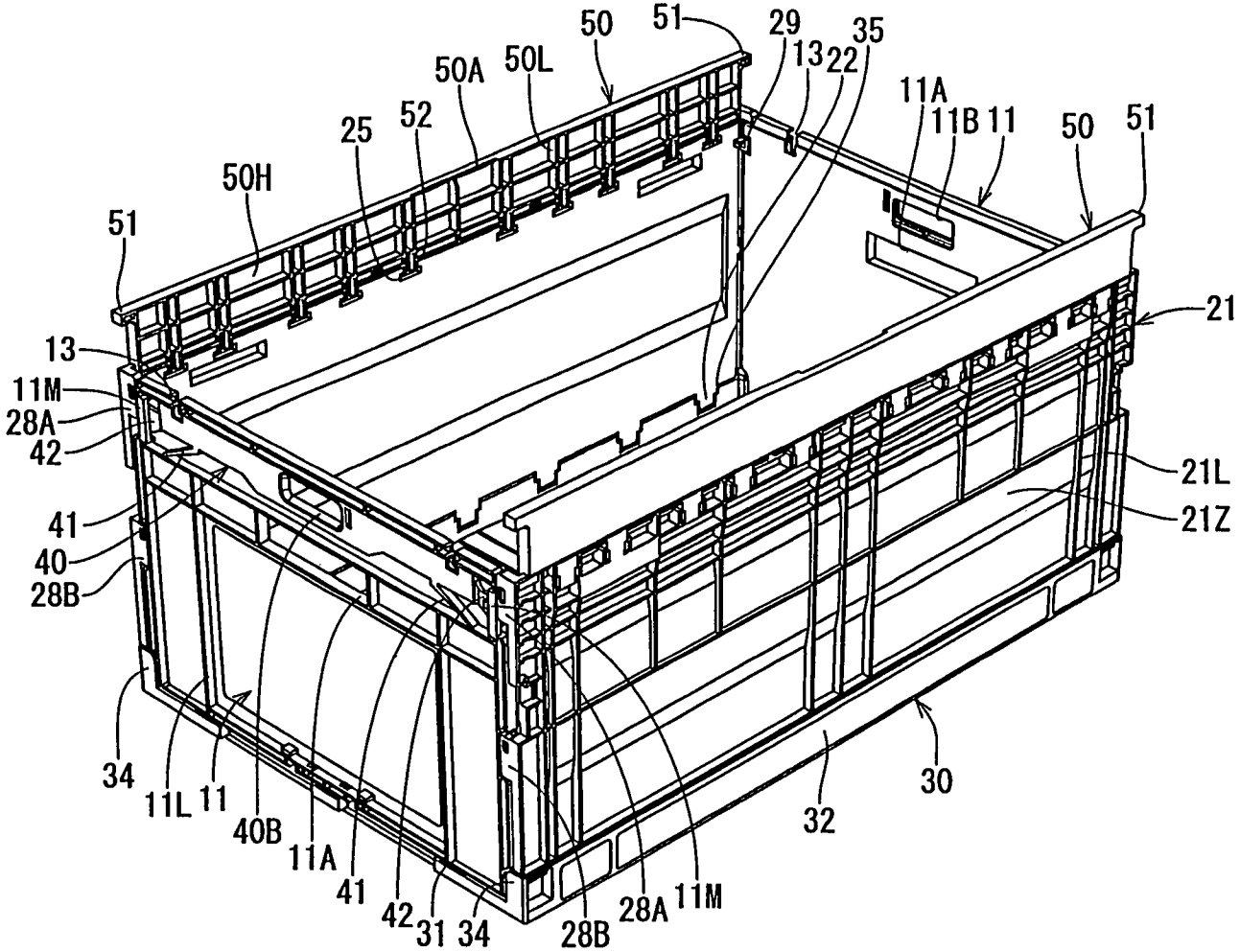
FIG. 2 is a perspective view of the collapsible container with band plate members assuming a rising state.

Two band plates 50 are pivotally connected to the upper ends of the long-side sidewalls 21 respectively as shown in FIG. 2. Each band plate member 50 extends along the upper end of the corresponding long-side sidewall 21 and has an inner surface on which a lattice-shaped reinforcing rib 50L is formed. Furthermore, each band plate member 50 has a widthwise side from which a hinge leg 52 protrudes and both lengthwise end faces on an end of a side distant from the hinge leg 52. Two horizontal-posture support protrusions 51 protrude from the end faces.

Figure 4:
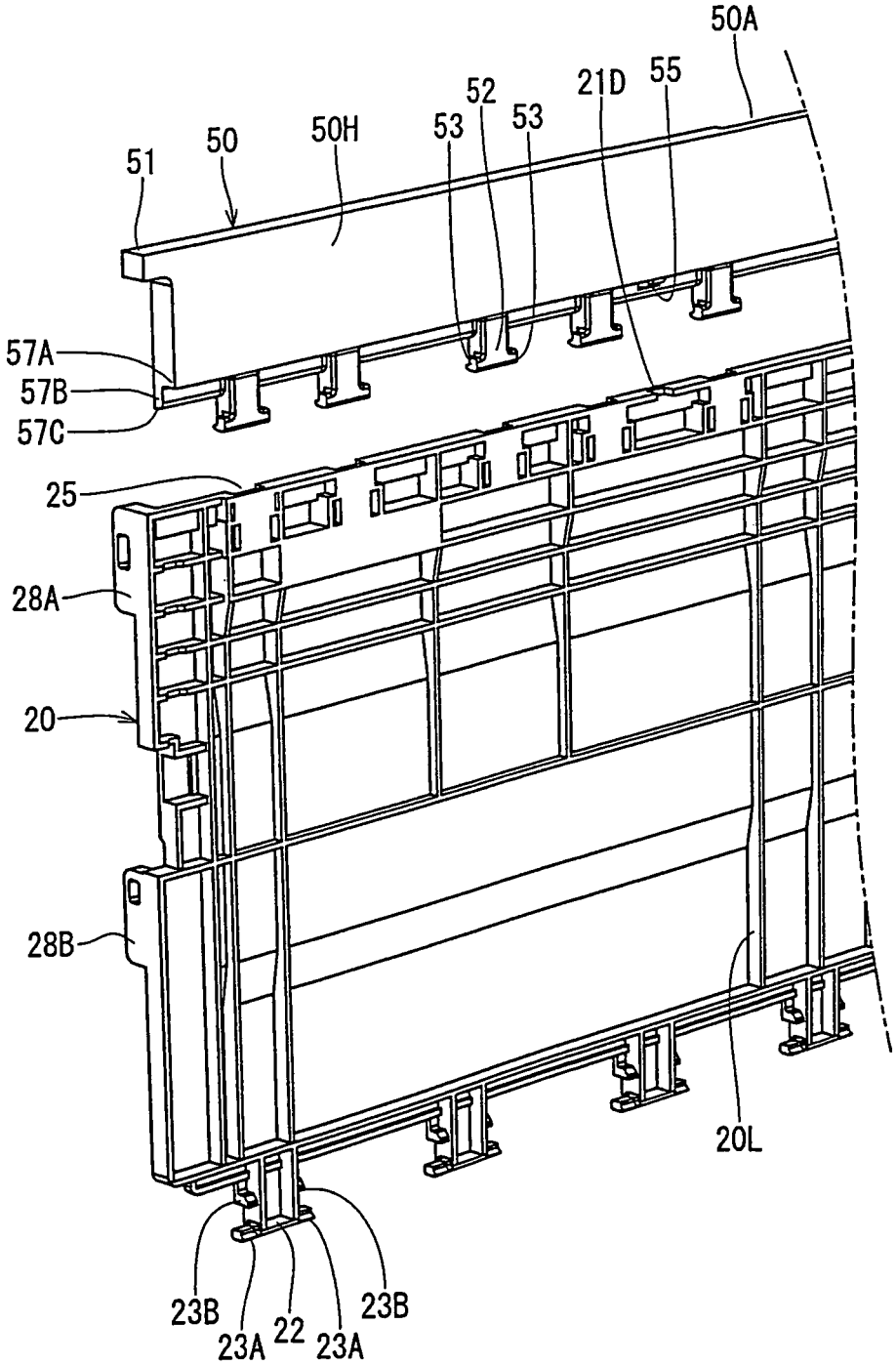
FIG. 4 is a perspective view of long-side sidewalls and band plate members as viewed from the outside of the collapsible container.

More specifically, each band plate member 50 includes a body 50H except the horizontal-posture support protrusions 51 and hinge legs 52. The body 50H has such an overall length that the body 50H fits between inner faces of the short-side sidewalls 11, as shown in FIG. 1. The body 50H has a width which is set so as to be equal to or smaller than one fifth of a lateral dimension of each short-side sidewall 11. Furthermore, as shown in FIG. 4, the body 50H has a widthwise side edge having a thinner portion 57B formed by stepping the outer face of the body 50H to come close to the inner side. Additionally, a handle 50A is formed on the lengthwise central part of an edge opposed to the thinner portion 57B of the body 50H as shown in FIG. 1. The handle 50A is formed by stepwisely reducing a projecting amount of the reinforcing rib 50L.

Figure 6:
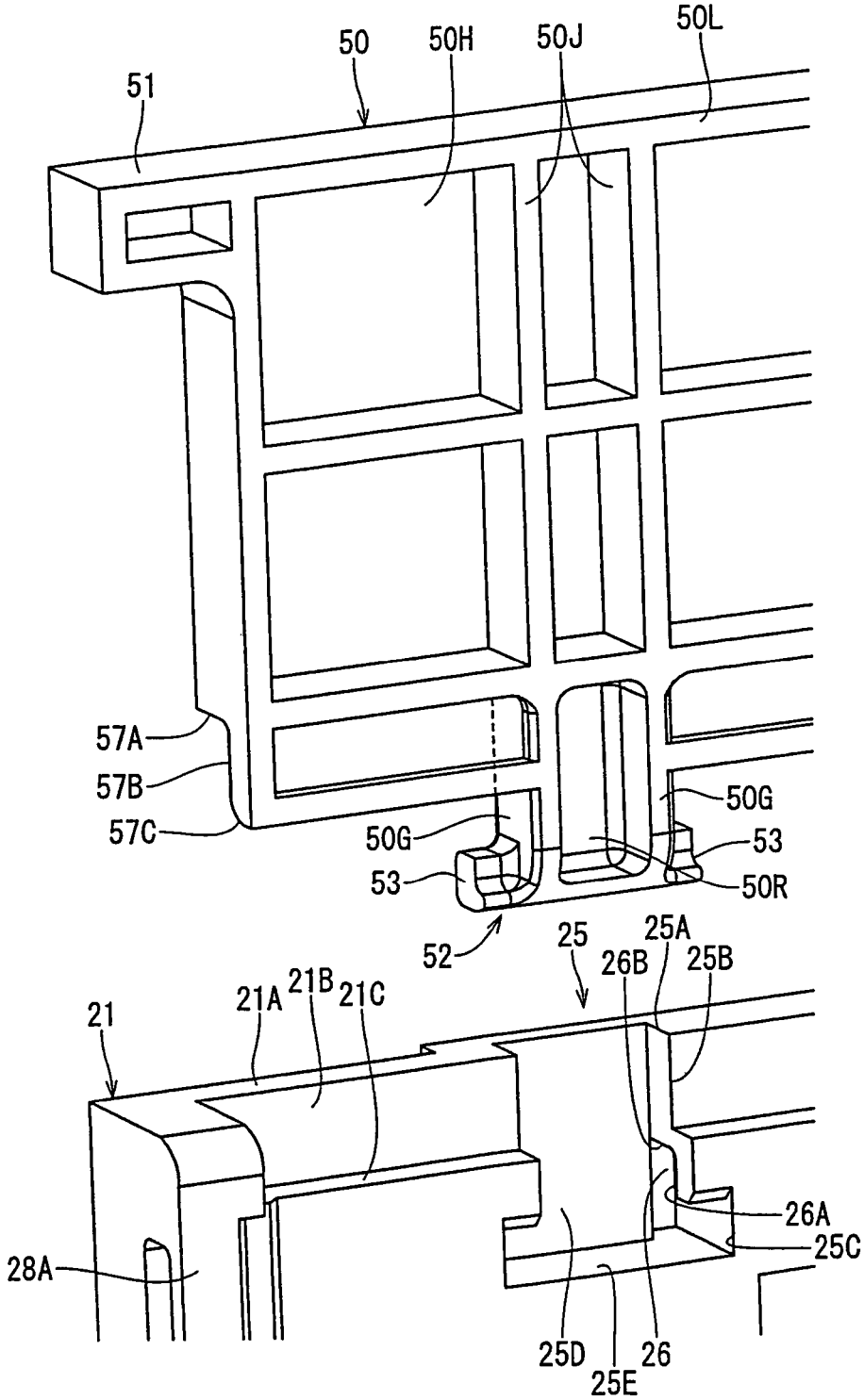
FIG. 6 is an enlarged perspective view of a part of the band plate member and an upper end of the long-side sidewall.

The reinforcing rib 50L is disposed over an entire edge of the inner surface of the body 50H as shown in FIG. 3. Furthermore, the reinforcing rib 50L includes a pair of longitudinal ribs 50J extending widthwise with respect to the band plate member 50 (vertical direction as viewed in FIG. 3). The longitudinal ribs 50J are dispersed over an entire lengthwise dimension of the band plate member 50 so as to assume a plurality of positions respectively. Furthermore, as shown in FIG. 6, two pairs of longitudinal ribs 50J are formed on the inner and outer surfaces of the thinner portion 57B of the body 50H respectively. Each pair of longitudinal ribs 50J are extended so as to protrude from the widthwise side 57C of the band plate member 50 to be formed into leg ribs 50G. Outer surface sides of both leg ribs 50G are connected by a connecting wall 50R, whereupon the hinge leg 52 is constructed.

The distal end of each hinge leg 52 includes both lengthwise sides with respect to the band plate member 50. A pair of hinge shafts 53 protrude in the opposite directions from the both lengthwise sides with respect to the band plate member 50. The hinge shaft 53 has an approximately L-shaped section. A side of the L-shape is disposed at the distal end side of the hinge leg 52. The other side of the L-shape is disposed at the outer surface (the connecting wall 50R) side of the hinge leg 52.

Figure 7:
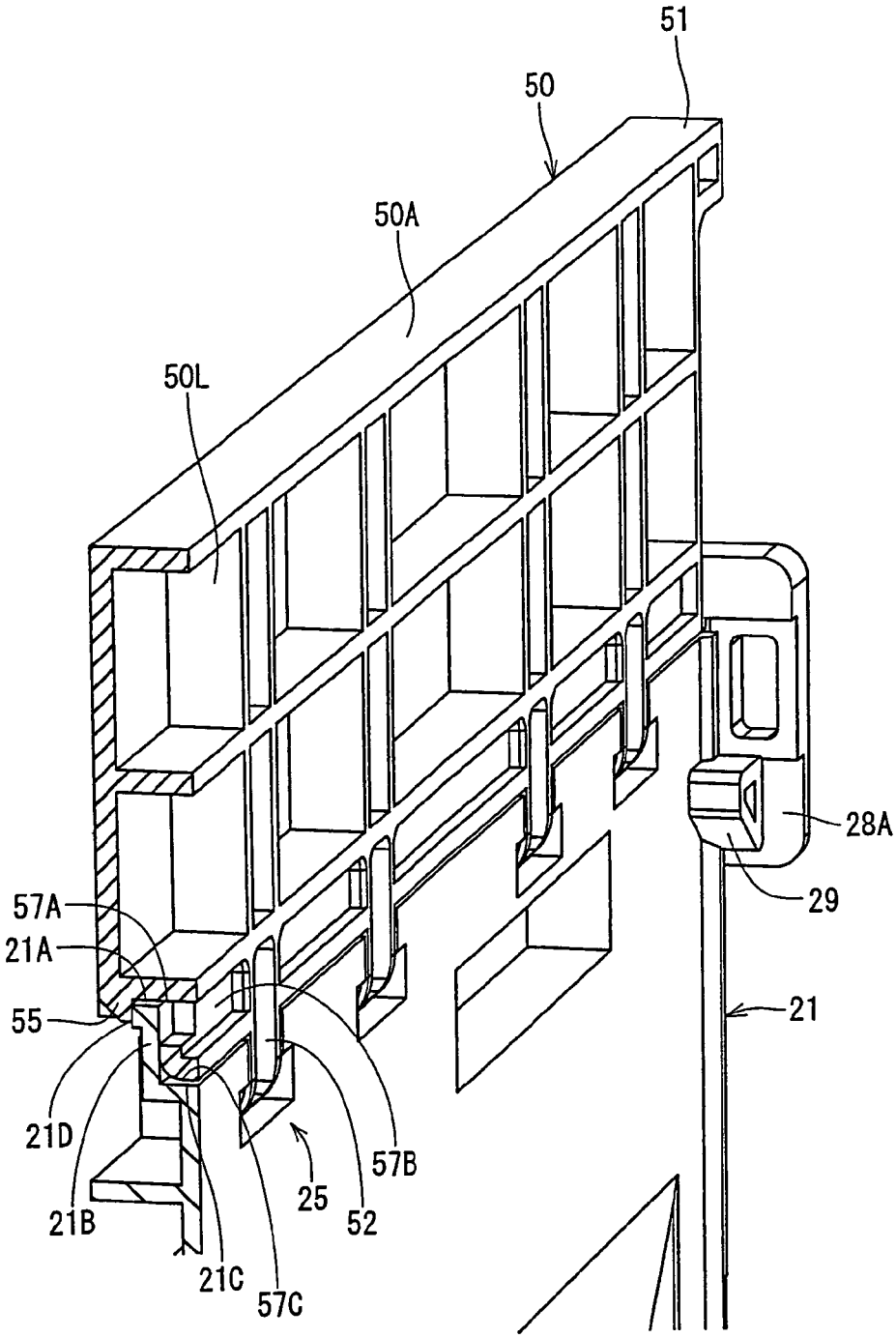
FIG. 7 is an enlarged perspective view of the band plate member assuming the rising state.
Figure 8:
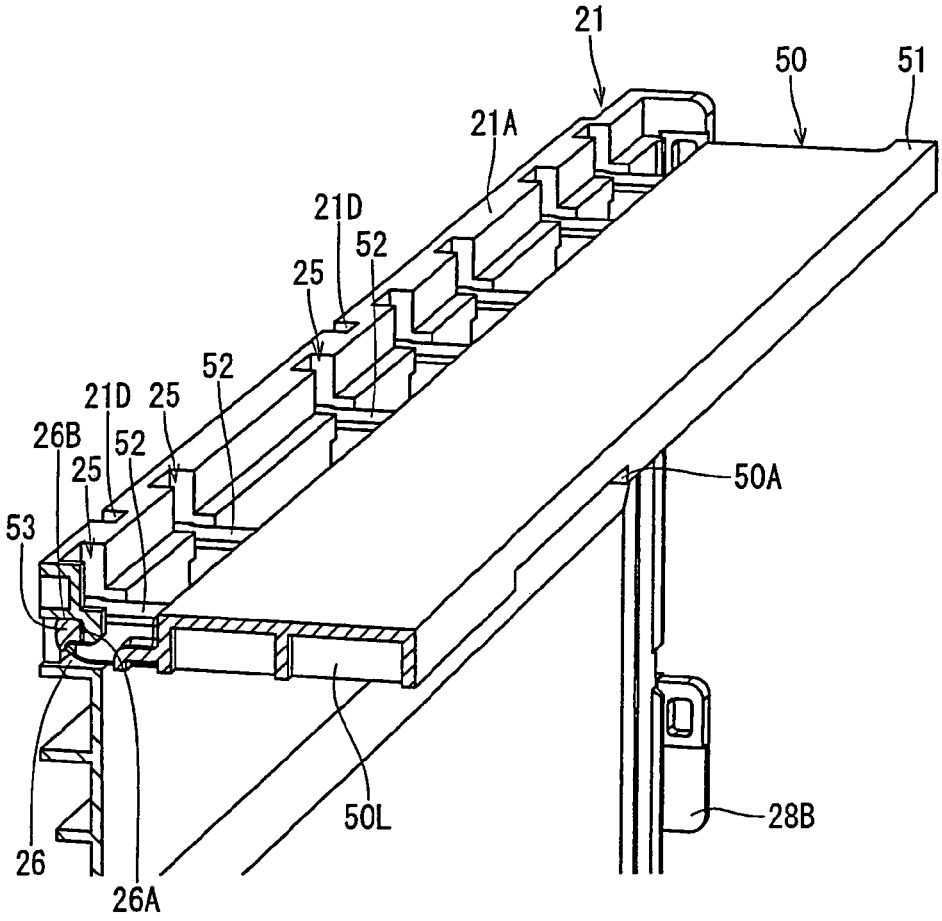
FIG. 8 is an enlarged perspective view of the band plate member assuming a horizontal state.

A step 57A is formed between the entire band plate member 50 and the thinner portion 57B as shown in FIG. 4. The step 57A has a pair of rising engagement protrusions 55 formed on a lengthwise middle thereof. FIG. 4 shows one of the rising engagement protrusions 55. The rising engagement protrusions 55 are located outside the step 57A of the band plate member 50 as shown in FIG. 7. Each rising engagement protrusion 55 has a triangular section and includes a locking face vertically rising from the step 57A and an inclining face obliquely rising from the step 57A. The locking face is located at an inner surface side of the band plate member 50 while the inclining face is located at another surface side of the band plate member 50. On the other hand, each long-side sidewall 21 has a pair of rising engagement recesses 21D formed in the upper surface thereof as shown in FIG. 8. The rising engagement recesses 21D are formed by cutting out an outer edge of the sidewall 21 into a rectangle at two positions corresponding to the paired engagement protrusions 55 respectively.

Figure 10A:
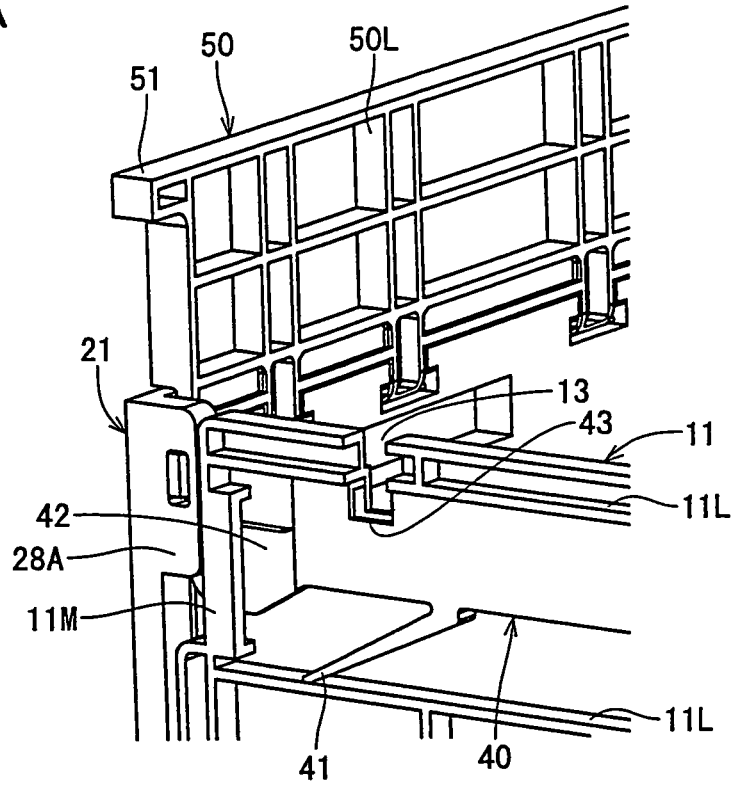
FIGS. 10A and 10B are perspective views of an upper end corner of the collapsible container.
Figure 11:
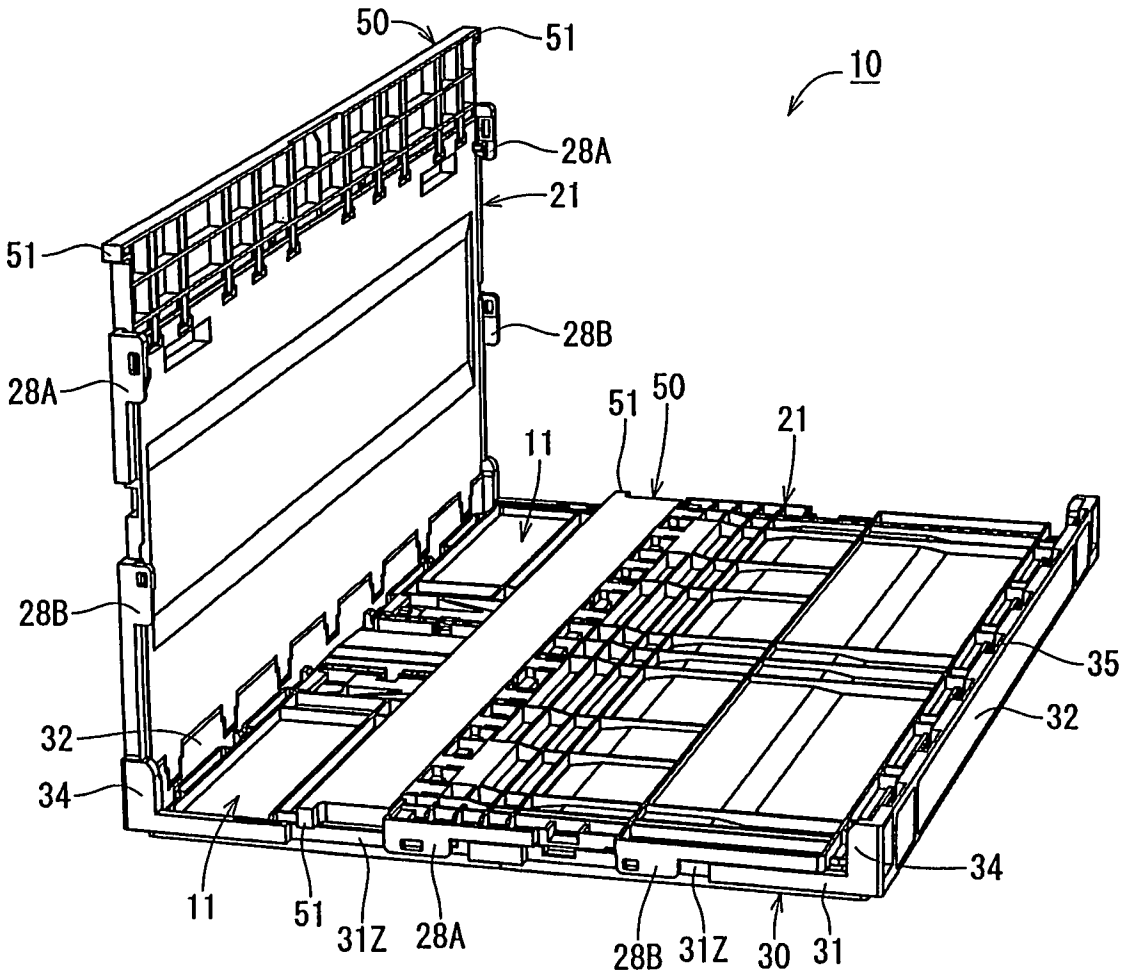
FIG. 11 is a perspective view of the collapsible container in the process of folding.

Each horizontal-posture support protrusion 51 has a prismatic shape as shown in FIG. 10A. Each short-side sidewall 11 has two horizontal-posture retaining recesses 13 formed by cutting out both lateral ends thereof into a rectangular shape respectively. Each horizontal-posture retaining recess 13 is open upward. Furthermore, the locking member 40 also has horizontal-posture retaining recesses 43 which are formed so as to overlap the horizontal-posture retaining recesses 13 and so as to be open upward.

A plurality of leg receiving recesses 25 are formed in the upper end of each long-side sidewall 21 so as to correspond to the hinge legs 52 respectively as shown in FIG. 3. The leg receiving recesses 25 and the hinge legs 52 constitute a band plate hinge mechanism which pivotably connect the band plate member 50 to each long-side sidewall 21. More specifically, as shown in FIG. 6, the upper end of each long-side sidewall 21 has a thinner portion 21B which has an outer face come closer to the inner face into the shape of a step. Each leg receiving recess 25 is open to the upper and inner surfaces of the long-side sidewall 21, and an inner opening 25B extends vertically while straddling a step 21C of each long-side sidewall 21.

The inner opening 25B of each leg receiving recess 25 has a lower end which is rendered broader lengthwise with respect to the long-side bottom protrusion 32 as compared with the upper end of each leg receiving recess 25. The lower end serves as a hinge shaft receiving hole 25C for receiving a pair of hinge shafts 53. A shaft positioning portion 26 is formed inside the leg receiving recess 25. The shaft positioning portion 26 extends from the heightwise middle of the leg receiving recess 25 to a bottom face 25E and has the same width as the hinge shaft receiving hole 25C. More specifically, an inner space of the hinge shaft receiving hole 25C is broadened upward by the shaft positioning portion 26.

The following describes the assembling of the band plate member 50 to each long-side sidewall 21. The hinge leg 52 of each band plate member 50 is received into the leg receiving recesses 25 from the inner surface side of the long-side sidewall 21 while each band plate member 50 assumes a rising posture with the hinge leg 52 being located at the lowest as shown in FIG. 3. In this case, the hinge shafts 53 protruding from the hinge leg 52 are received through the hinge shaft receiving holes 25C into the leg receiving recesses 25 respectively. Each hinge shaft receiving hole 25C is sized so that the hinge shaft 53 can just pass therethrough, and the inner part of the hinge shaft receiving hole 25C is rendered broader upward by the shaft positioning portion 26. Accordingly, once the hinge shaft 53 is received in the inner part of the hinge shaft receiving hole 25C, the hinge shaft 53 is caught by an open edge of the hinge shaft receiving hole 25C at the shaft positioning portion 26 side, whereupon the hinge leg 52 cannot easily be departed from the leg receiving recess 25. Thus, the band plate member 50 is mounted on each long-side sidewall 21.

The band plate member 50 can be caused to pivot about the hinge shaft 53 as connected to each long-side sidewall 21. The band plate member 50 assumes the rising posture at one end of a pivotable range, whereas the band plate member 50 assumes the horizontal posture at the other end of the pivotable range. More specifically, when the band plate member 50 assumes the rising posture, the thinner portions 21B and 57B of each long-side sidewall 21 and the band plate member 50 are opposed to each other, whereupon outward pivoting of the band plate member 50 beyond the rising posture is limited. Furthermore, the step 21C of each long-side sidewall 21 and the side 57C of the band plate member 50 abut against each other or the top surface 21A of each long-side sidewall 21 and the step 57A of the band plate member 50 abut against each other. Consequently, the band plate member 50 rises independently from each long-side sidewall 21. Furthermore, when the rising engagement protrusion 55 is locked in the rising engagement recess 21D, the band plate member 50 is retained in the rising posture. The inner surfaces of the band plate member 50 and each long-side sidewall 21 are coplanar when the band plate member 50 assumes the rising posture.

Figure 10B:
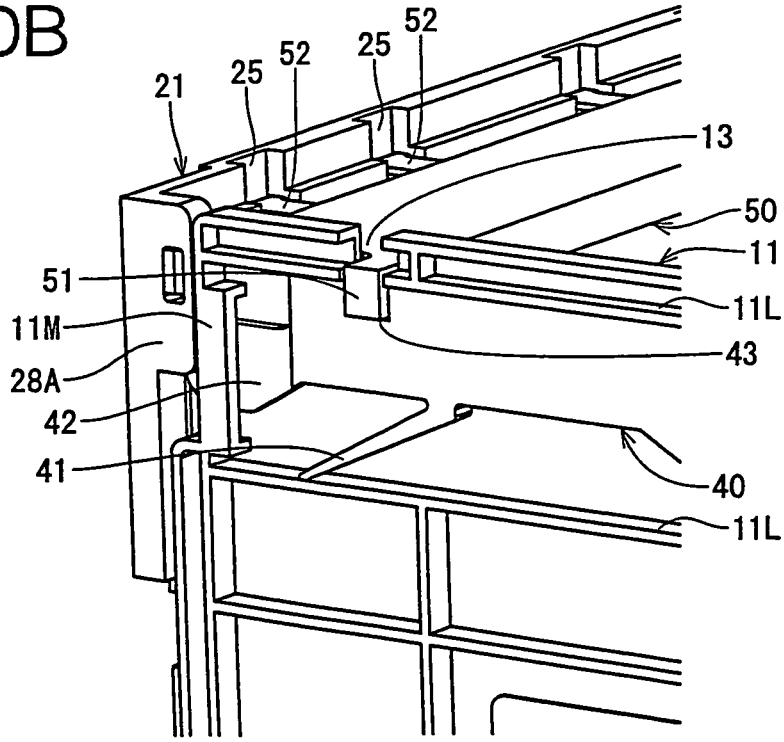

When the band plate member 50 assuming the rising posture is lifted upward, the rising engagement protrusion 55 is disengaged from the rising engagement recess 21D, whereby the band plate member 50 can be caused to fall inward. When being caused to pivot inward 90 degrees from the rising posture as shown in FIG. 10A, the band plate member 50 then assumes the horizontal posture as shown in FIG. 10B. As a result, the horizontal-posture support protrusions 51 are received by the horizontal-posture retaining recesses 13, 43 of each short-side sidewall 11 and locking member 40 thereby being supported by each short-side sidewall 11 from below, whereupon downward pivoting lower than the horizontal posture of the band plate member 50 can be limited.

Furthermore, when the band plate member 50 assumes the horizontal posture, the inner surface of each hinge leg 52 is directed downward, abutting against the bottom face 25E of the leg receiving recess 25, and the hinge shaft 53 is moved upward, as shown in FIG. 8. The hinge shaft 53 then abuts against a ceiling 26B of the shaft positioning portion 26, so that upward movement of the hinge shaft 53 is limited. Consequently, the downward pivoting lower than the horizontal posture of the band plate member 50 can also be limited.

Figure 9:
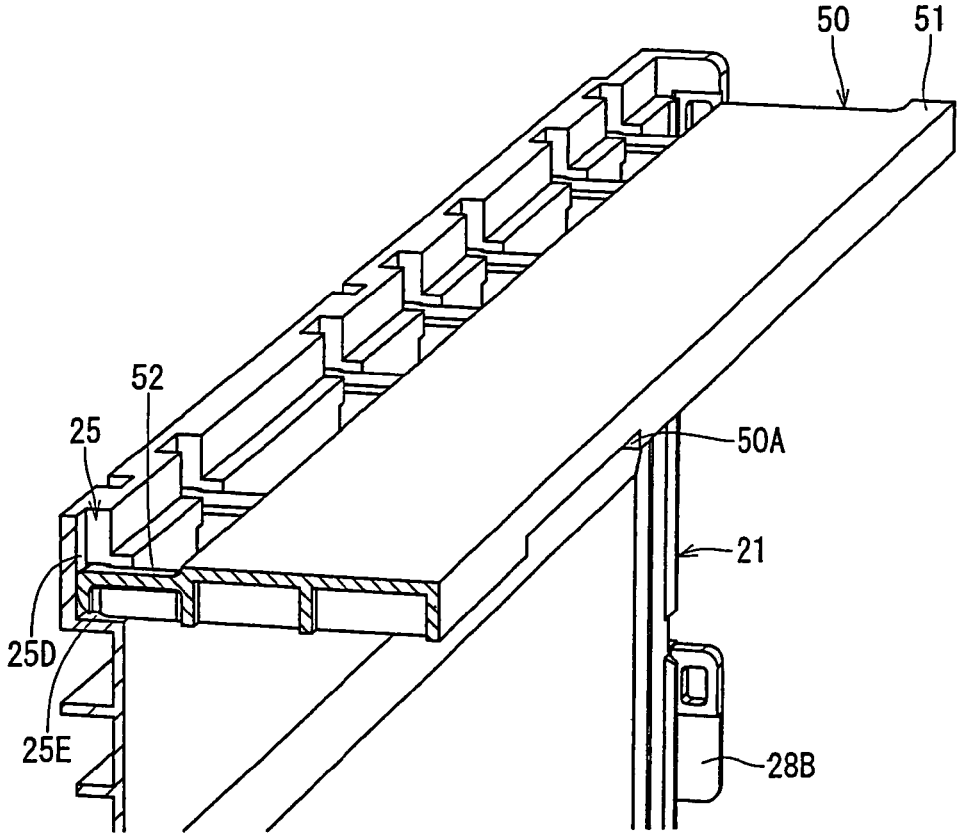
FIG. 9 is another enlarged perspective view of the band plate member assuming the horizontal state.

Still furthermore, when the band plate member 50 assumes the horizontal posture, the hinge shaft 53 abuts against the inner locking face 26A of the shaft positioning portion 26, and the distal end of each hinge leg 52 abuts against an inner face 25D which is near to the outer side of the leg receiving recess 25 as shown in FIG. 9. As a result, the inward or outward movement to each long-side sidewall 21 of the band plate member 50 assuming the horizontal posture is limited. More specifically, when the band plate member 50 assumes the horizontal posture, each hinge leg 52 is positioned with respect to three of directions intersecting the hinge shaft 53 except for the downward direction. The downward movement of each hinge leg 52 is thus limited by the self-weight of the band plate member 50 assuming the horizontal posture. Consequently, the band plate member 50 assuming the horizontal posture is united with each long-side sidewall 21 thereby serving as a rib reinforcing each long-side sidewall 50.

The operation and advantages of the collapsible container 10 will now be described. When an article is to be put into and taken out of the collapsible container 10, the band plate member 50 is caused to assume the rising posture as shown in FIG. 2. As a result, the upper opening of the collapsible container 10 is spread, so that the article can be put into and taken out of the collapsible container 10 more efficiently. Furthermore, when the band plate member 50 is caused to assume the rising posture, the band plate member 50 is rendered coplanar with the inner surface of each long-side sidewall 21. Consequently, the article cannot be caught by the step between the band plate member 50 and each long-side sidewall 21.

When the articles have been accommodated in the collapsible container 10, the band plate member 50 is maintained in the horizontal posture. As a result, the articles can be restrained from scattering out of the collapsible container 10 during transportation, and the long-side sidewalls 21 can be prevented from bending deformation. More specifically, the band plate member 50 is connected to each long-side sidewall 21 at a plurality of positions dispersed over the entire lengthwise dimension of the upper edge of each long-side sidewall 21. Accordingly, the band plate member 50 assuming the horizontal posture serves as a rib reinforcing the entire lengthwise dimension of each long-side sidewall 21, so that the bending deformation of each long-side sidewall 21 can be restrained. In particular, when a large number of small articles such as bolts are accommodated in the collapsible container 10, the pressure of the articles is applied to each long-side sidewall 21, whereupon the effect of reinforcement by the band plate member 50 assuming the horizontal posture is increased. Furthermore, since each band plate member 50 assuming the horizontal posture is located between the short-side sidewalls 11, the band plate member 50 serves to prevent each short-side sidewall 11 from falling inward, and the short-side and long-side sidewalls 11 and 21 are retained in the intersecting state so that the whole of the collapsible container 10 can be prevented from being twisted.

When a large number of small articles are accommodated in the collapsible container 10, the band plate members 50 may previously be caused to assume the horizontal posture at the time of accommodation of the articles so that the deformation of the long-side sidewalls 21 can be restrained.

When folded, the collapsible container 10 can be returned from a destination without taking up much space. In order that the collapsible container 10 may be folded into the folded state, the band plate members 50 are caused to rise, and the locking member 40 is caused to move downward so that the short-side and long-side sidewalls 11 and 21 are released from the locked state. The short-side sidewalls 11 are folded so as to be laid on the bottom wall 30. One of the long-side sidewalls 21 is laid on the short-side sidewalls 11. The connecting protrusions 28A and 28B of the folded long-side sidewall 21 are accommodated in notches 31Z of the short-side bottom protrusions 31 of the bottom wall 30 as shown in FIG. 11. Next, the other long-side sidewall 21 and band plate member 50 are folded so as to be laid on the one long-side sidewall 21 and band plate member 50. The connecting protrusions 28A and 28B of the other long-side sidewall 21 are arranged as displaced relative to the connecting protrusions 28A and 28B of the one long-side sidewall 21 and the horizontal-posture support protrusion 51 of the band plate member 50 as shown in FIG. 12. Furthermore, the connecting protrusion 28A of the other long-side sidewall 21 is accommodated in the notch 31Z in the side edge of the one long-side sidewall 21. As a result, an increase in the height of the collapsible container 10 in the folded state can be restrained.

Figure 14:
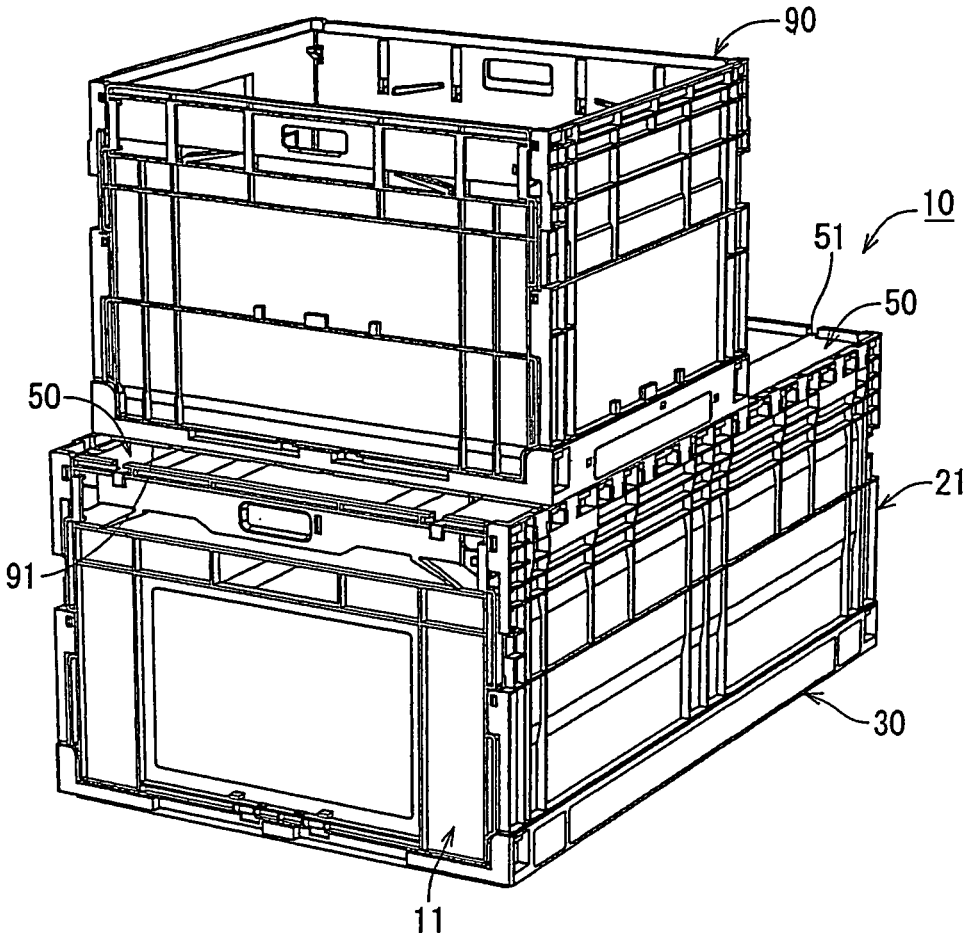
FIG. 14 is a perspective view of the collapsible container and another container stacked on the collapsible container.

Another container can be laid on the collapsible container 10 of the embodiment when the collapsible container 10 is in the assembled state with the band plate members 50 assuming the horizontal posture. FIG. 14 exemplifies a case where a small container 90 half the size of the collapsible container 10 of the embodiment is laid on the collapsible container 10.

When laid on the collapsible container 10, the small container 90 is arranged such that an underside protrusion 91 formed on the underside thereof is accommodated between the long-side sidewalls 21 to be disposed on the upper face of the collapsible container 10. An outer edge of the underside of the small container 90 abuts against the upper faces 21A of the long-side sidewalls 21, whereby the load of the small container 90 is supported by the collapsible container 10. The underside protrusion 91 is accommodated in a step between the upper face 21A of the long-side sidewall 21 and the band plate member 50 assuming the horizontal posture, whereupon the lateral slip can be prevented.

Figure 15:
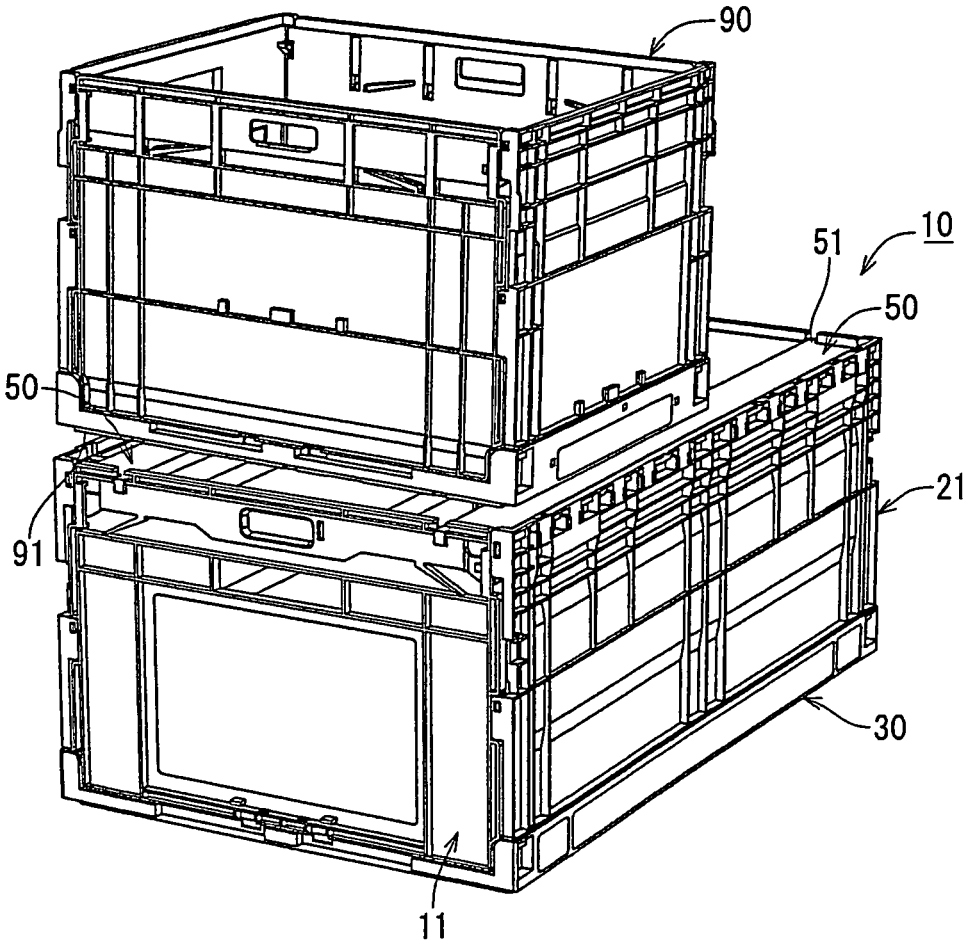
FIG. 15 is a perspective view of the collapsible container and another container stacked on the collapsible container and displaced.

Suppose now that the small container 90 be displaced from a normal position while being laid on the collapsible container 10, as shown in FIG. 15. In this case, however, the small container 90 is supported by the band plate members 50 assuming the horizontal state from below. As a result, the small container 90 cannot fall into the collapsible container 10. The small container 90 can be slid on the band plate members 50 to be moved to the normal position on the collapsible container 10. More specifically, the small container 90 can be laid on a rough position on the collapsible container 10 and then fine adjusted so as to be moved to the normal position. Consequently, the piling work can be rendered easier in the collapsible container 10 than in the conventional containers.

Furthermore, since the long-side sidewalls 21 are thinner, a slight deformation in the long-side sidewalls 21 would disenable the small container 90 to be laid on the collapsible container 10. In such a case, however, the small container 90 can be supported by the band plate members 50 from below instead of the long-side sidewalls 21 and laid on the collapsible container 10. In the embodiment, the horizontal-posture support protrusions 51 provided on the pivoting end of each band plate member 50 are supported by the short-side sidewalls 11 from below. Consequently, the band plate members 50 can be prevented from being deformed by the load of the small container 90 and accordingly, the small container 90 can be supported stably.

As described above, the collapsible container 10 of the embodiment is provided with the band plate members 50, so that another container can be prevented from falling into the collapsible container 10 when laid on the latter. Accordingly, the container piling work can be carried out easier. Furthermore, the strength of the collapsible container 10 in the assembled state can be increased by the band plate members 50.

Figure 16:
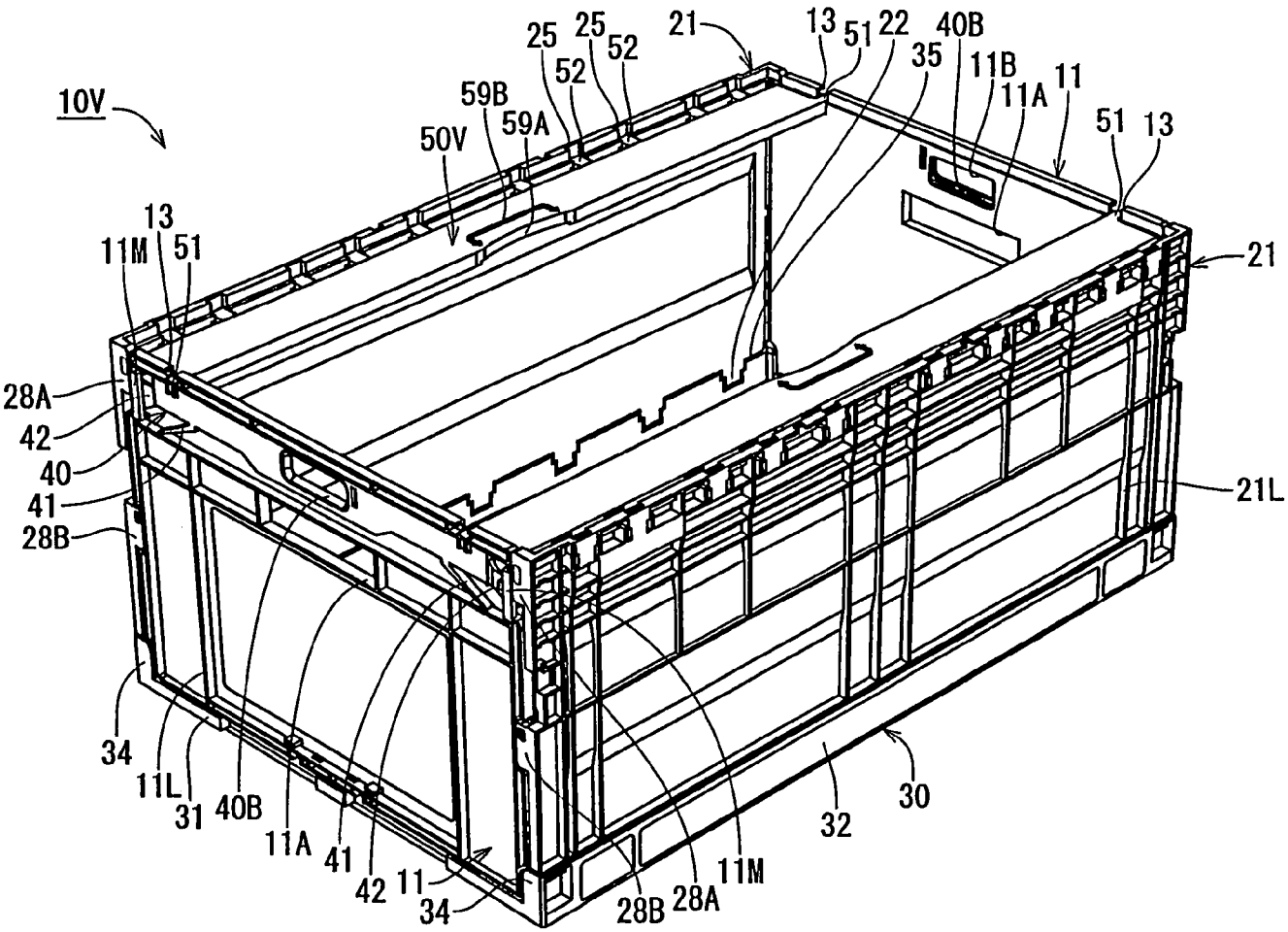
FIG. 16 is a perspective view of a collapsible container in accordance with a second embodiment of the invention.

FIGS. 16 and 17 illustrate a second embodiment of the invention. A collapsible container 10V of the second embodiment differs only in the structure of a band plate member 50V from the first embodiment. A handy-grip recess mark 59B is affixed to the lengthwise central portion of the band plate member 50V as shown in FIG. 16. A handy-grip recess 59A is formed in the lengthwise central portion of the side at the pivoting end side of the band plate member 50V. The handy-grip recess 59A is formed into an arc-shaped recess. As the result of the foregoing construction, an operator can put his hands on the handy-grip recesses 59A on the lengthwise central portion of the band plate members 50V using the handy-grip mark 59B as a guide so as to pivot the band plates 50V smoothly.

Figure 17A:
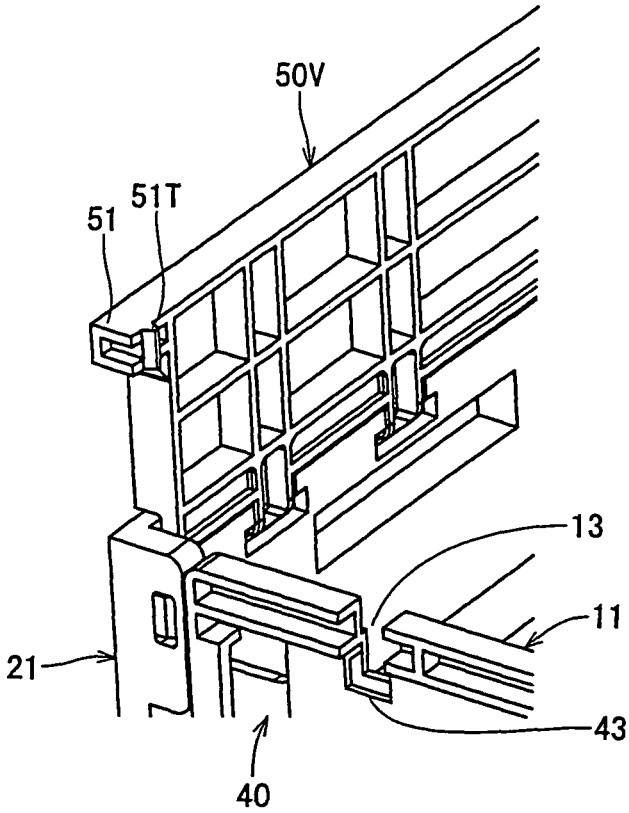
FIG. 17 is a perspective view of an upper end corner of the collapsible container.
Figure 17B:
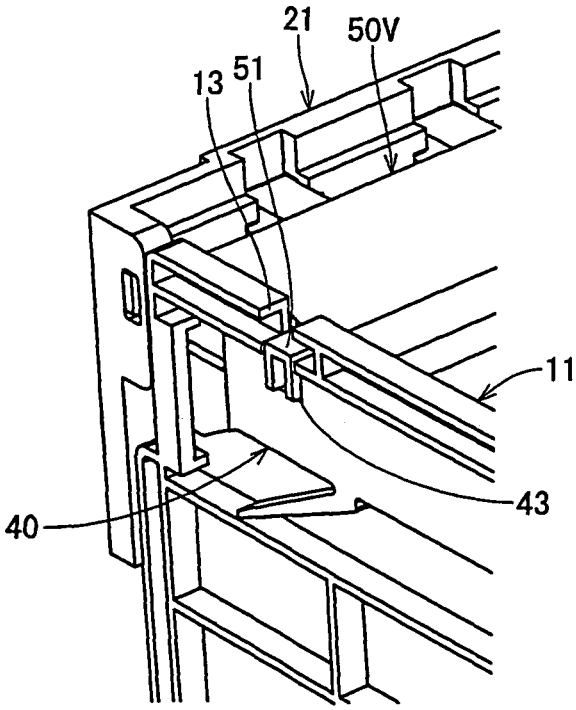

Furthermore, as shown in FIG. 17A, the horizontal-posture support protrusion 51 is formed with a triangular protrusion 51T. When the horizontal-posture support protrusion 51 is engaged with the horizontal-posture retaining recesses 13 and 43 of the short-side sidewall 11 and the locking member 40, the triangular protrusion 51T enters into the gap between the bottoms of the horizontal-posture retaining recesses 13 and 43, as shown in FIG. 17B, whereupon the inward or outward movement of the short-side sidewall 11 can be prevented.

Figure 18:
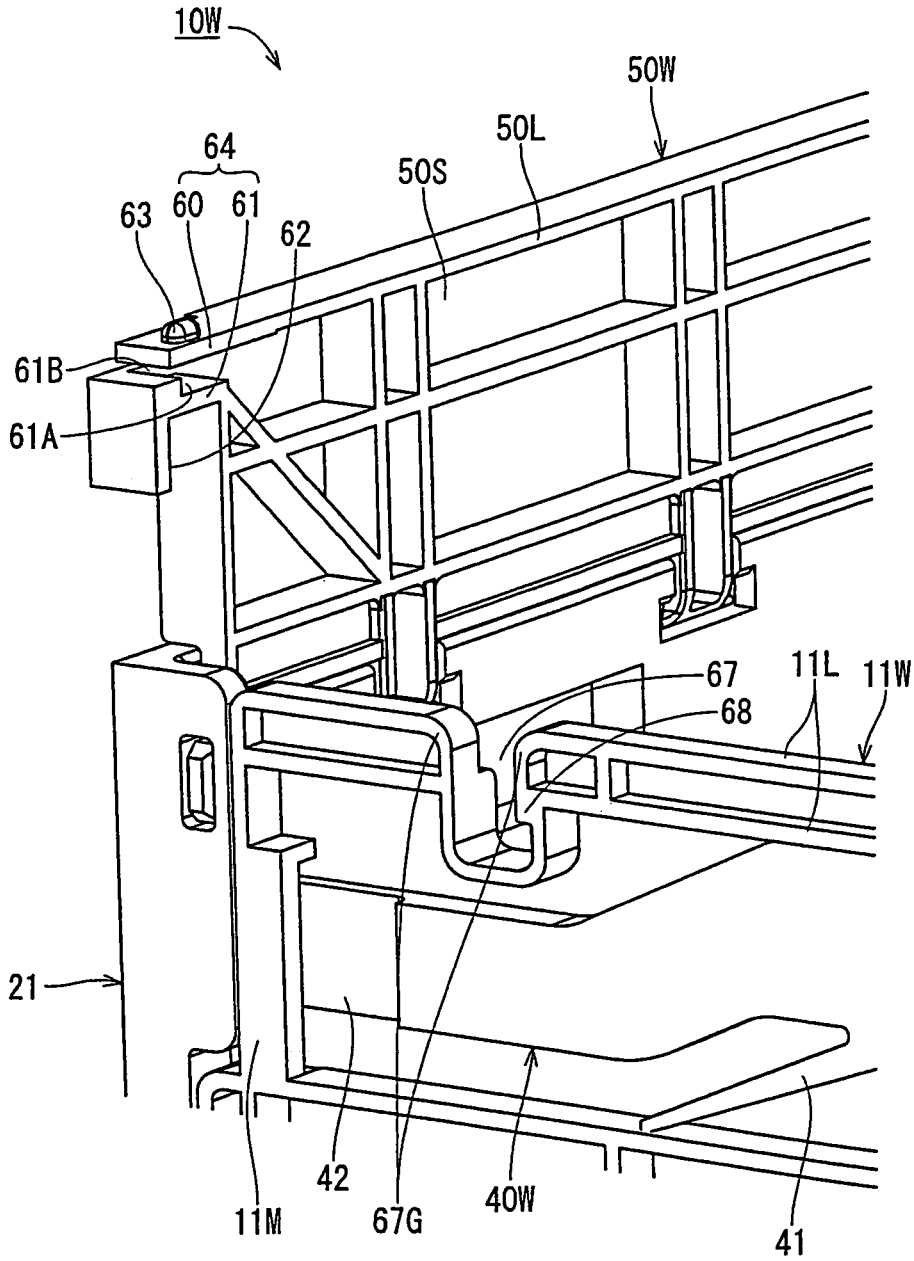
FIG. 18 is a perspective view of an upper end corner of a collapsible container in accordance with a third embodiment of the invention.
Figure 19:
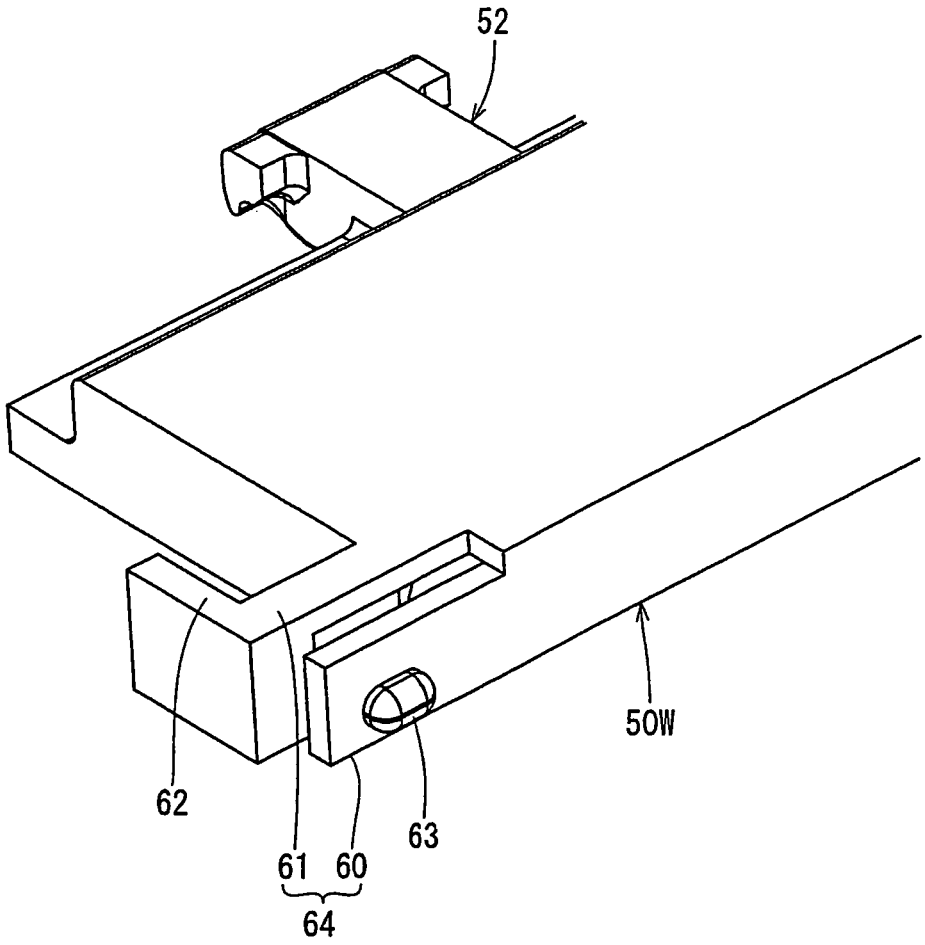
FIG. 19 is an enlarged perspective view of the band plate member assuming the horizontal state.
Figure 20:
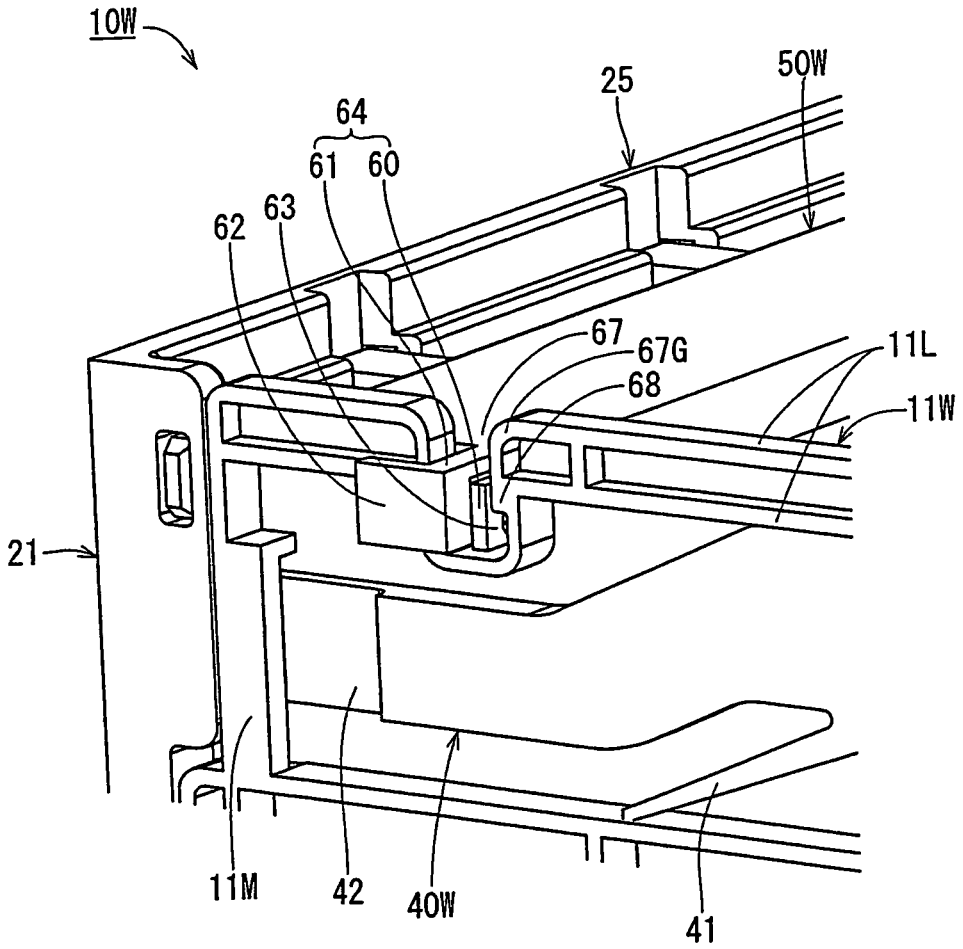
FIG. 20 is a perspective view of the upper end corner of the collapsible container.

FIGS. 18 to 20 illustrate a third embodiment of the invention. A collapsible container 10W of the third embodiment differs mainly in the structure of a horizontal-posture support protrusion 64 and a horizontal-posture retaining recess 67 from the first embodiment. The horizontal-posture support protrusion 64 in the third embodiment is bifurcated into an elastic protrusion 60 and a fixed protrusion 61 as shown in FIG. 18. The elastic protrusion 60 is formed by extending sideways the reinforcing rib 50L on the edge which is away from the center of pivoting of the band plate member 50W. Furthermore, the elastic protrusion 60 has a horizontal-posture support protrusion 63 formed on the side thereof opposed to the center of pivoting. The horizontal-posture support protrusion 63 is formed into an oval shape and extends along the protruding direction of the elastic protrusion 60 as shown in FIG. 19. The horizontal-posture support protrusion 63 rises vertically form the outer face of the elastic protrusion 60 and is rounded from the middle thereof to the distal end thereof. The whole horizontal-posture support protrusion 63 is generally dome-shaped.

On the other hand, the fixed protrusion 61 is disposed at a location near the center of pivoting of the band plate member 50W with a gap which is substantially the same as an amount of protrusion of the horizontal-posture support protrusion 63 relative to the elastic protrusion 60 as shown in FIG. 18. More specifically, the fixed protrusion 61 is formed by joining a side edge of a first protruding wall 61A extending in parallel to the elastic protrusion 60 with a second protruding wall 61B formed by extending a part of a main plate 50S which is a part of the band plate member 50W and on which the reinforcing rib 50L extends. Furthermore, the fixed protrusion 61 has a distal end from which a protrusion-like bent piece 62 extends toward the center of pivoting of the band plate member 50W. The bent piece 62 has a proximal end which is connected to distal edges of the first and second protruding walls 61A and 61B for co-reinforcement.

The horizontal-posture retaining recess 67 in the third embodiment includes a lower inner part which is rendered broader in a stepped manner toward the central side of the short-side sidewall 11W in the longitudinal direction as compared with the upper end side entrance thereof. A step in the horizontal-posture retaining recess 67 serves as an inner lock portion 68 with which the horizontal-posture support protrusion 63 is engageable. Furthermore, an outer rib 11L is formed into a curved shape along the edge in the interior of the horizontal-posture retaining recess 67. A guide 67G is formed by connecting the outer rib 11L in the horizontal-posture retaining recess 67 to another outer rib 11L provided along the upper edge of the short-side sidewall 11W such that the entrance of the horizontal-posture retaining recess 67 is gradually spread upward. In the third embodiment, a locking member 40W provided on the short-side sidewall 11W is bent into the shape of a downward crank at a location near the horizontal both ends in order to avoid interference with the outer rib 11L in the horizontal-posture retaining recess 67.

According to the third embodiment, when the band plate member 50W is changed from the rising posture to the horizontal posture and the horizontal-posture support protrusion 64 is thrust into the horizontal-posture retaining recess 67, the horizontal-posture support protrusion 63 is brought into a sliding contact with the guide 67G of the horizontal-posture retaining recess 67, whereupon the elastic protrusion 60 flexes to the fixed protrusion 61 side. When the horizontal-posture support protrusion 64 is then thrust deep into the horizontal-posture retaining recess 67, the elastic protrusion 60 is elastically restored, whereupon the horizontal-state support protrusion 63 is locked by an innermost lock portion 68. As a result, for example, the band plate member 50W cannot be caused to pivot by gravity even when the collapsible container 10W is put upside down, so that the band plate member 50W can be prevented from being unstable. Furthermore, when the horizontal-posture support protrusion 64 is thrust deep into the horizontal-posture retaining recess 67, each short-side sidewall 11 is held between a side of the band plate member 50W and the bent piece 62, whereupon the whole collapsible container 10W can effectively be prevented from being twisted.

The invention should not be limited by the foregoing embodiments. For example, the following forms encompass the technical scope of the invention.

Figure 21:
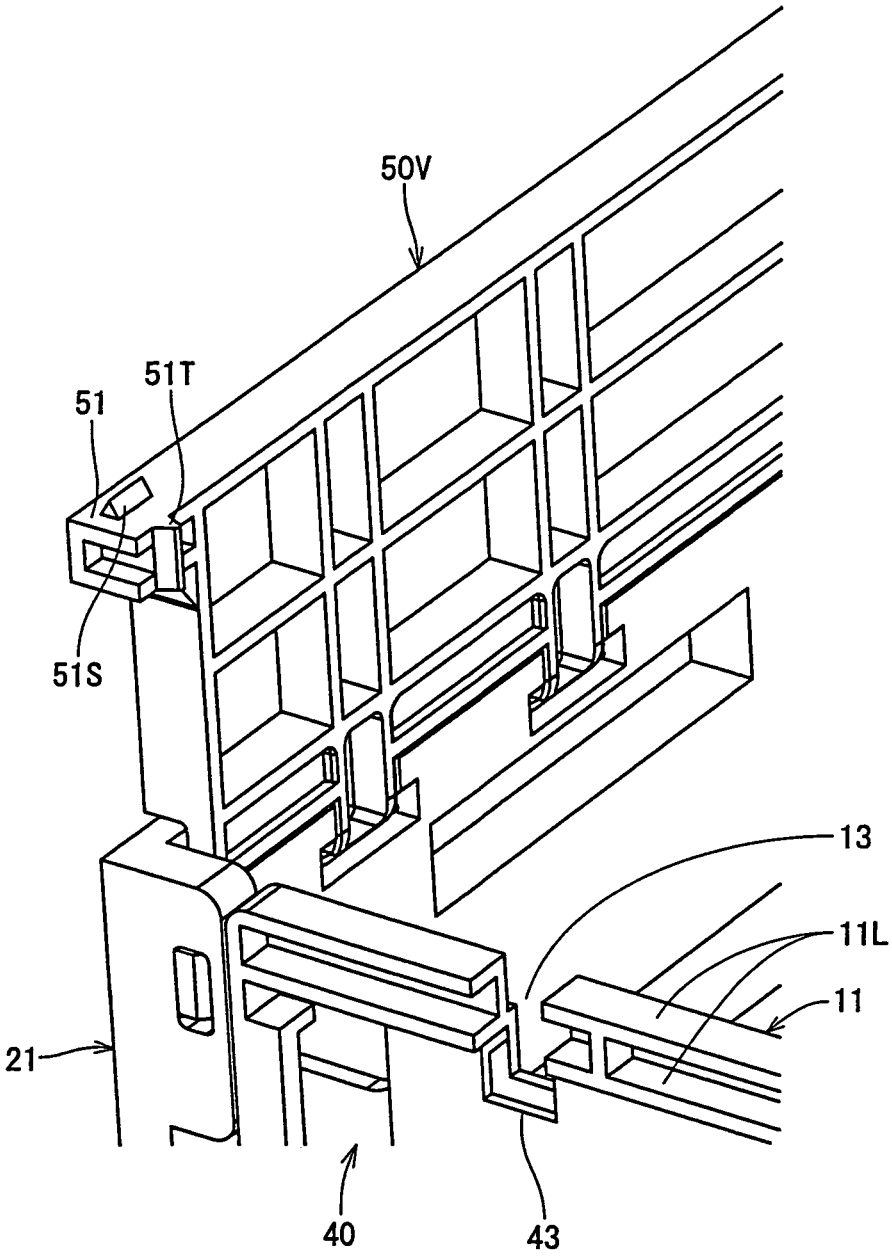
FIG. 21 is a perspective view of an upper end corner of a collapsible container of a modified form.

The horizontal-posture support protrusion 51 described in the second embodiment may be provided with a horizontal-posture retaining protrusion 51S protruding toward the inside of each of the horizontal-posture retaining recesses 13 and 43 as shown in FIG. 21. In this case, when the horizontal-posture support protrusion 51 is engaged with the horizontal-posture retaining recesses 13 and 43, the horizontal-posture retaining protrusion 51S is locked by the underside of the outer rib 11L of the short-side sidewall 11 so that the band plate member 50 can be held in the horizontal posture.

The band plate members 50, 50V and 50W in the first to third embodiments are provided with the horizontal-posture support protrusions 51, 51V and 64 so as to be supported in the horizontal posture by the short-side sidewall 11, too. However, the band plate member may be supported in the horizontal posture only by the band plate hinge mechanism between the band plate member and the long-side sidewall without the horizontal-posture support protrusion.

The band plate members 50, 50V and 50W are pivotally connected to the long-side sidewalls 21 in the collapsible containers 10, 10V and 10W of the first to third embodiments. However, the band plate members 50, 50V and 50W may pivotally be connected to the short-side sidewalls 11.

Although the planar shape of each of the collapsible containers 10, 10V and 10W is rectangular, the planar shape may be square.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A collapsible container comprising:

a rectangular bottom wall;

sidewalls composed of a pair of first sidewalls opposed to each other and a pair of second sidewalls opposed to each other, the pair of first sidewalls and the pair of second sidewalls being pivotally joined to respective outer edges of the bottom wall and being capable of entering a folded state in which the pair of second sidewalls and the pair of first sidewalls are folded on the bottom wall, in this order, and an assembled state in which the pair of first sidewalls and the pair of second sidewalls are raised from the bottom wall, in this order, the assembled state preventing the pair of first sidewalls from falling over on the bottom wall using the pair of second sidewalls held between the pair of first sidewalls;

a pair of band plate members extending along upper edges of the pair of first sidewalls;

a band plate hinge mechanism joining the band plate members near to top surfaces of the pair of first sidewalls, the band plate members configured to pivot between a horizontal posture of protruding inward from the first sidewalls horizontally and a rising posture of rising upward from the first sidewalls vertically, the band plate hinge mechanism being capable of positioning the band plate members in the horizontal posture, wherein, when the band plate members assume the horizontal posture, the band plate members are displaced lower relative to the top surfaces of the pair of first sidewalls than when the band plate members assume the rising posture, wherein the band plate members assuming the horizontal posture also are displaced between the raised pair of second sidewalls;

rising engagement recesses formed by partially notching a corner portion between an upper surface and an outside surface of the pair of first sidewalls; and rising engagement protrusions on an outer edge of a side of each band plate member, wherein the side of each band plate member is laid on the upper surface of the pair of first sidewalls when the band plate members assume the rising posture such that the rising engagement recesses engage with the rising engagement protrusions when the band plate members assume the rising posture and retain the band plate members in the rising posture, thereafter holding the band plate members in the rising posture, and wherein the rising engagement protrusions extend vertically when the band plate members assume the rising posture.

2. The collapsible container according to claim 1, wherein each band plate member has both lengthwise end faces formed with a pair of horizontal-posture support protrusions located at ends of a side distant from a center of pivoting, and the pair of second sidewalls which are sidewalls other than the first sidewalls have upper edges whose positions away from the first sidewalls are formed with horizontal retaining recesses which receive the horizontal-posture support protrusions and then support the protrusions from below when the band plate members assume the horizontal posture.

3. The collapsible container according to claim 1, wherein a depth of the partially notched corner portion is less than a thickness of a sidewall at the upper surface.

4. A collapsible container comprising:

a rectangular bottom wall;

sidewalls composed of a pair of first sidewalls opposed to each other and a pair of second sidewalls opposed to each other, the pair of first sidewalls and the pair of second sidewalls being pivotally joined to respective outer edges of the bottom wall and being capable of entering a folded state in which the pair of second sidewalls and the pair of first sidewalls are folded on the bottom wall, in this order, and an assembled state in which the pair of first sidewalls and the pair of second sidewalls are raised from the bottom wall, in this order, the assembled state preventing the pair of first sidewalls from falling over on the bottom wall using the pair of second sidewalls held between the pair of first sidewalls;

a pair of band plate members extending along upper edges of the pair of first sidewalls; and a band plate hinge mechanism joining the band plate members near to top surfaces of the pair of first sidewalls, the band plate members configured to pivot between a horizontal posture of protruding inward from the first sidewalls horizontally and a rising posture of rising upward from the first sidewalls vertically, the band plate hinge mechanism being capable of positioning the band plate members in the horizontal posture, wherein when the band plate members assume the horizontal posture, the band plate members are displaced lower relative to the top surfaces of the pair of first sidewalls than when the band plate members assume the rising posture, wherein the band plate members assuming the horizontal posture also are displaced between the raised pair of second sidewalls, the band plate hinge mechanism joins the band plate members to the first sidewalls at a plurality of positions dispersed over the entire upper edges of the first sidewalls, the band plate hinge mechanism further including:

a plurality of leg receiving recesses that are formed in the upper ends of the first sidewalls, the recesses being open to top faces and inner faces of the first sidewalls;

a plurality of hinge legs protruding sideways from a side directed widthwise with respect to the band plate members, received in the plurality of leg receiving recesses, and abutting against a bottom face of each leg receiving recess when the band plate members assume the horizontal posture;

a pair of hinge shafts protruding from regions of both sides at a distal end portion of each hinge leg, the sides of each hinge leg being orthogonal to a width direction of each hinge leg, each hinge shaft having a long distance from the bottom face of the leg receiving recess to an upper end of the hinge shaft when the band plate members assume the horizontal posture as compared with when the band plate members assume the rising posture;

a pair of hinge shaft receiving portions formed by laterally widening a lower end portion of each leg receiving recess, the hinge shaft receiving portions receiving the pair of hinge shafts;

a pair of first abutting portions provided to the pair of hinge shaft receiving portions, the first abutting portions abutting against the pair of hinge shafts from above when the band plate members assume the horizontal posture;

a pair of second abutting portions provided to the pair of hinge shaft receiving portions, the second abutting portions abutting against the pair of hinge shafts from an inner surface side of the first sidewalls when the band plate members assume the horizontal posture; and a pair of hinge shaft receiving entrances that are formed by opening portions of the pair of hinge shaft receiving portions vertically sandwiched between the second abutting portions and the bottom face of the leg receiving recess toward the inner surface side of the first sidewalls, the hinge shaft receiving recesses being sized so that the pair of hinge shafts can just pass therethrough without deformation of the hinge shafts and hinge shaft receiving entrances when the band plate members assume the rising posture.

5. A collapsible container comprising:

a rectangular bottom wall;

sidewalls composed of a pair of first sidewalls opposed to each other and a pair of second sidewalls opposed to each other, the pair of first sidewalls and the pair of second sidewalls being pivotally joined to respective outer edges of the bottom wall and being capable of entering a folded state in which the pair of second sidewalls and the pair of first sidewalls are folded on the bottom wall, in this order, and an assembled state in which the pair of first sidewalls and the pair of second sidewalls are raised from the bottom wall, in this order, the assembled state preventing the pair of first sidewalls from falling over on the bottom wall using the pair of second sidewalls held between the pair of first sidewalls;

a pair of band plate members extending along upper edges of the pair of first sidewalls; and a band plate hinge mechanism joining the band plate members near to top surfaces of the pair of first sidewalls, the band plate members configured to pivot between a horizontal posture of protruding inward from the first sidewalls horizontally and a rising posture of rising upward from the first sidewalls vertically, the band plate hinge mechanism being capable of positioning the band plate members in the horizontal posture, wherein when the band plate members assume the horizontal posture, the band plate members are displaced lower relative to the top surfaces of the pair of first sidewalls than when the band plate members assume the rising posture, wherein the band plate members plate members assume the rising posture and retain the band plate members in the rising posture, thereafter holding the band plate members in the rising posture.

6. The collapsible container according to claim 5, further comprising rising engagement protrusions formed on an outer edge of a side of each band plate member and rising engagement recesses formed by partially notching a corner portion between an upper surface and an outer surface of the pair of first sidewalls such that the rising engagement recesses engage with the rising engagement protrusions when the band assuming the horizontal posture also are displaced between the raised pair of second sidewalls, the band plate hinge mechanism joins the band plate members to the first sidewalls at a plurality of positions dispersed over the entire upper edges of the first sidewalls, the band plate hinge mechanism further including:

a plurality of hinge legs protruding sideways from a side directed widthwise with respect to the band plate members;

a pair of hinge shafts protruding from regions of both sides of each hinge leg, the sides of each hinge leg being orthogonal to a width direction of each hinge leg, each hinge shaft having a length from a distal end of the hinge shaft relative to an integrated band plate member to a proximate end of the hinge shaft relative to the integrated band plate member that is less than a thickness of each hinge leg, the hinge shafts being formed closer to an outside edge than an inside edge in a thickness direction of each hinge leg;

a plurality of leg receiving recesses which are formed in the upper ends of the first sidewalls, the recesses being open to top faces and inner faces of the first sidewalls and receiving the hinge legs together with the hinge shafts respectively;

hinge shaft receiving entrances which are formed by laterally widening lower ends of the inner face openings of the leg receiving recesses, the inner face openings being open to the inner faces of the first sidewalls, the hinge shaft receiving entrances having a vertical opening width less than the thickness of each hinge leg and being sized so that the hinge shafts can just pass therethrough without deformation of the hinge shafts and hinge shaft receiving entrances when the band plate members assume the rising posture, wherein the rising posture is a posture assumed by the band plate member when the hinge legs are located at a lowest location; and shaft positioning portions formed in the leg receiving recesses by upwardly widening inner portions of the hinge shaft receiving entrances, the shaft positioning portions being engaged with the hinge shafts when the band plate members assume the horizontal posture, wherein:

the hinge legs are received in the leg receiving recesses together with the hinge shafts with the band plate members assuming th rising posture; and when the band plate members are caus d to assume the horizontal posture, the hinge legs and bottom faces of the leg receiving recesses are abutted against each other, so that the hinge shafts are moved upward to be received by the shaft positioning portions, whereby the hinge legs are positioned in three of directions orthogonal to the hinge shafts except for a downward direction.

7. The collapsible container according to claim 6, wherein each band plate member has both lengthwise end faces formed with a pair of horizontal-posture support protrusions located at ends of a side distant from a center of pivoting, and the pair of second sidewalls which are sidewalls other than the first sidewalls have upper edges whose positions away from the first sidewalls are formed with horizontal retaining recesses which receive the horizontal-posture support protrusions and then support the protrusions from below when the band plate members assume the horizontal posture.

8. The collapsible container according to claim 5, wherein each band plate member has both lengthwise end faces formed with a pair of horizontal-posture support protrusions located at ends of a side distant from a center of pivoting, and the pair of second sidewalls which are sidewalls other than the first sidewalls have upper edges whose positions away from the first sidewalls are formed with horizontal retaining recesses which receive the horizontal-posture support protrusions and then support the protrusions from below when the band plate members assume the horizontal posture.

* * * * *